US006733117B2

(12) United States Patent
Tajima et al.

(10) Patent No.: US 6,733,117 B2
(45) Date of Patent: May 11, 2004

(54) PRESSURE ADJUSTMENT CHAMBER, INK-JET RECORDING HEAD HAVING THE SAME, AND INK-JET RECORDING DEVICE USING THE SAME

(75) Inventors: Hiroki Tajima, Kanagawa (JP); Yutaka Koizumi, Kanagawa (JP); Akihiro Yamanaka, Kanagawa (JP); Hiroyuki Maeda, Kanagawa (JP); Akira Goto, Kanagawa (JP); Takeshi Kono, Kanagawa (JP); Itaru Watanabe, Kanagawa (JP); Takeshi Yamaguchi, Kanagawa (JP); Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/067,754

(22) Filed: Feb. 8, 2002

(65) Prior Publication Data

US 2002/0118242 A1 Aug. 29, 2002

(30) Foreign Application Priority Data

Feb. 9, 2001 (JP) ..... 2001-033632
Feb. 9, 2001 (JP) ..... 2001-033634
Feb. 6, 2002 (JP) ..... 2002-029049

(51) Int. Cl.[7] ..... B41J 2/175
(52) U.S. Cl. ..... 347/87
(58) Field of Search ..... 347/85–87

(56) References Cited

U.S. PATENT DOCUMENTS 4,714,937 A 12/1987 Kaplinsky
4,885,595 A 12/1989 Kaplinsky et al.
5,682,190 A 10/1997 Hirosawa et al. ..... 347/94
5,764,259 A 6/1998 Nakajima ..... 347/86
6,264,319 B1 * 7/2001 Altfather et al. ..... 347/86

FOREIGN PATENT DOCUMENTS

EP 0 519 453 12/1992
JP 04 369554 12/1992
JP 10 296988 11/1998

* cited by examiner

*Primary Examiner*—Judy Nguyen
(74) *Attorney, Agent, or Firm*—Fitzpatrick, Cella, Harper & Scinto

(57) ABSTRACT

The present invention discloses an elastic transformable body for adjusting vapor pressure, a vapor pressure adjustment chamber using the same, an ink-jet recording head having a vapor pressure adjustment device and an ink-jet recording device having the recording head, and more particularly to a vapor pressure adjustment device for adjusting negative pressure generated in a liquid chamber in an ink-jet recording head when discharging ink. The pressure adjustment chamber has at least one elastic transformation body having a changeable volume according to vapor pressure to adjust the vapor pressure in a container communicated thereto and a support for supporting the elastic transformation body to the container. In the pressure adjustment chamber, the elastic transformation body includes an approximately circular opening and two surfaces approximately flat before transformation at an outer circumference, in which the two surfaces have a shape extended through a curved portion at a front end opposite to the opening.

12 Claims, 16 Drawing Sheets

PRESSURE ADJUSTMENT CHAMBER, INK-JET RECORDING HEAD HAVING THE SAME, AND INK-JET RECORDING DEVICE USING THE SAME

BACKGROUND OF THE INVENTION

1. Field of the Invention

The present invention relates to an elastic transformable body for adjusting vapor pressure, a vapor pressure adjustment chamber using the same, an ink-jet recording head having a vapor pressure adjustment device and an ink-jet recording device having the recording head, and more particularly to a vapor pressure adjustment device for adjusting negative pressure generated in a liquid chamber in an ink-jet recording head when discharging ink.

2. Related Background Art

Among recording methods such a printer, the ink-jet recording method to form text or image on a recording medium by discharging ink from a discharging hole (a nozzle) is a non-impact recording method, which enables high-speed recording with high density, so being broadly applied.

A general ink-jet recording device includes an ink-jet recording head, a means for driving a carriage having the ink-jet recording head, a means for carrying the recording medium, and a controller for controlling the driving means. Such an operation to perform recording with moving the carriage is called as a serial type. On the other hand, the manner of performing recording only with carrying a recording medium without moving the recording head is called as a line type. In the line-type ink-jet recording device, the ink-jet recording head has a plurality of nozzles arranged to a width of the recording medium along overall width.

Because discharging ink drop from the nozzles, the ink-jet recording head includes an energy generating means to generate discharging energy exerted to the ink in the nozzles. As the energy generating means, there are used ones of using an electric-mechanical converting element such as piezo element, using electric-thermal converting element such as a heating resistance, or using an electronic wave-mechanical converting element or an electronic wave-thermal converting element for converting electronic wave into mechanical vibration or heat such as an electronic wave laser. Among them, the manner of discharging ink drops by using the thermal energy may arrange the nozzle in very high density, so enabling recording in high resolution. Particularly, the ink-jet recording head using the electric-thermal converting element as the energy generating element is more easily scaled down rather than the one using the electric-mechanical converting element, and furthermore when adapting an IC technique or micro-processing technique with technical advance and improved reliability in the recent semiconductor making field to fully utilize their benefits, there are also advantages of high density, easy mounting and lowered manufacturing costs.

As for supplying the ink to the ink-jet recording head, there are a so-called head tank integrated manner in which an ink tank containing the ink is integrated with the ink-jet recording head, a so-called tube supplying manner in which the ink tank is connected to the ink-jet recording head through a tube, and a so-called pit-in manner in which the ink tank is independently installed to the ink-jet recording head, moving the ink-jet recording head to the ink tank to connect them as required, and then supplying the ink from the ink tank to the ink-jet recording head therebetween.

If increasing capacity of the ink tank to reduce frequency of changing the ink tank, the weight of ink tank is also increased, which is not preferred in the head-tank integrated manner of the serial-type ink-jet recording device, considering that the load exerted on the carriage is increased. Therefore, the serial-type ink-jet recording device using the mass capacity ink tank usually adopts the tube supplying manner or the pit-in manner. Among them, since the pit-in manner requires stopping the recording process during supplying the ink, the tube supplying manner which may operate in longer time is better adopted.

An ink supplying system of the tube supplying type ink-jet recording device is described below with reference to FIGS. 10A and 10B.

The ink supplying system shown in FIGS. 10A and 10B includes a main tank 304 containing ink 309 therein, a supply unit 305 detachably mounted to the main tank 304, and a recording head connected through a supply tube 306 to the supply unit 305.

The supply unit 305 has an ink chamber 305*f* therein. The ink chamber 305*f* is opened by an atmosphere hole 305*g* and at the same time connected to the supply tube 306 through a bottom of the ink chamber 305*f*. The supply unit 305 also has hollow ink supply needles 305*a* of which lower ends are positioned in the ink chamber 305*f* and upper ends are protruded from an upper surface of the supply unit 305, and the lower ends of the hollow ink supply needles 305*a* are positioned lower than lower ends of atmosphere introduction needles 305*b*.

The ink tank 304 has at a bottom two connectors having a rubber stopper to seal the main tank 304, and has an independent sealed structure with the main tank 304. When mounting the main tank 304 to the supply unit 305, the ink supply needles 305*a* and the atmosphere introduction needles 305*b* are respectively inserted in the main tank 304 through the connectors. Since positions of the lower ends of the ink supply needles 305*a* and the atmosphere introduction needles 305*b* are set as above, the ink in the main tank 304 is supplied to the ink chamber 305*f* through the ink supply needles 305*a*, and the atmosphere is introduced in the main tank 304 through the atmosphere introduction needles 305*b* to supplement the pressure decrease in the main tank 304. If the ink is supplied in the ink chamber 305*f* up to the level that a lower end of the atmosphere introduction needles 305*b* are soaked in the ink, the atmosphere is not introduced in the main tank 304 so that supplying ink from the ink tank 304 to the ink chamber 305*f* is stopped.

The recording head 301 has a sub tank 301*b* for accumulating a constant amount of ink as an ink container, an ink discharging unit 301*g* in which a plurality of nozzles for discharging ink are arranged, and a flow channel 301*f* connecting the sub tank 301*b* to the ink discharging unit 301*g*. In the ink discharging unit 301*g*, the nozzle has an open channel downward and the ink is discharged downward. In each nozzle of the ink discharging unit 301*g*, the above-described energy generating means is installed. The sub tank 301*b* is positioned above the ink discharging unit 301*g*, the supply tube 306 is positioned above the ink discharging unit 301*g*, and the supply tube 306 is connected to the sub tank 301*b*. Between the sub tank 301*b* and a flow channel 301*f*, there is attached a filter 301*c* having a fine mesh structure to prevent the nozzle from plugging caused from that minute impurities in the ink are infiltrated into the ink discharging unit 301*g*.

An area of the filter 301*c* is set to regulate pressure loss less than an allowance value. The pressure loss at the filter

301*c* is increased as the mesh of the filter 301*c* is finer and as a flow rate of the ink passing the filter 301*c* is larger. On the contrary, the area of the filter 301*c* is in inverse proportion. The recent recording head of multi-nozzle and small head tends to increase the pressure loss, so the size of the filter 301*c* is made as larger as possible to restrain the increase of pressure loss.

On an upper surface of the recording head 301, installed is an elastic member 321 having an appearance of an approximate rectangular shape in order to form a pressure adjustment chamber 322 for adjusting pressure in the sub tank 301*b* by absorbing abrupt change of pressure in the sub tank 301*b*. The pressure adjustment chamber 322 is connected only into the sub tank 301 through an opening 301*d* formed on an upper wall of the recording head 301. As the elastic member 321 transforms according to the pressure change in the sub tank 301*b*, volume of the pressure adjustment chamber 322 changes to absorb the pressure change of the sub tank 301*b*. A shape of a section of the elastic member 321 in parallel to an upper surface of the recording head 301 has a size nearly equal to or less than the upper surface of the recording head 301. In such a reason, a certain height is required to obtain a required volume of the pressure adjustment chamber 322.

Because the nozzle of the ink discharging unit 301*g* is open to the atmosphere and the opening is toward lower direction, the inner of the recording head 301 is required to maintain negative pressure in order to prevent the ink from leaking from the nozzle. On the other hand, if the negative pressure is too large, air is infiltrated into the nozzle so making it impossible to discharge ink from the nozzle. Therefore, in order to maintain suitable negative pressure in the recording head 301, the recording head 301 is arranged so that the opening of the nozzle is positioned higher as much as a height H than a liquid surface of the ink in the ink chamber 305*f*, so maintaining the inner of the recording head 301 to the negative pressure of a water head difference value of the height H. As a result, the nozzle is maintained to be fully filled with the ink with forming a meniscus on the opening.

The ink is discharged from the nozzle by pressing out the ink in the nozzle with use of driving force of the energy generating means. After discharging the ink, the nozzle is filled with ink by the capillary force. The processes of discharging ink from the nozzle and filling the nozzle with ink are repeated, and the ink is sucked in from the ink chamber 305*f* through the supply tube 306.

If the ink in the ink chamber 305*f* is sucked up to the recording head 301 so that the liquid surface of the ink in the ink chamber 305*f* is lower than a lower end of the atmosphere introduction needle 305*b*, the atmosphere is introduced in the main tank 304 through the atmosphere introduction needle, the ink in the main tank 304 is therefore supplied to the ink chamber 305*f*, and then the lower end of the atmosphere introduction needle 305*b* is soaked again into the ink of the ink chamber 305*f*, With repeating such operations, the ink in the main tank 304 is supplied to the recording head 301 according to discharging of ink from the recording head 301.

By the way, in the sub tank 301*b* of the recording head 301, the air infiltrated by permeation of resin materials such as the supply tube 306 or the air dissolved in the ink are gradually accumulated. In order to discharge the residual air accumulated in the sub tank 301*b*, the sub tank 301*b* is connected to an exhaust tube 301*a* connected to an exhaust pump 301*c*. But, as described above, a valve 310*b* is installed to the exhaust tube 310*a* in order to maintain suitable negative pressure in the recording head 301. The recording head 301 is regulated not to be into the atmosphere pressure by opening the valve 310*b* only when discharging the air.

In addition, in case that the ink discharging unit 301*g* is clogged with thickening things of the ink or the residual air dissolved in the ink is accumulated and saturated in the ink discharging unit 301*g*, a recovery unit 307 is generaly installed to the ink-jet recording device to eliminate the air. The recovery unit 307 includes a cap 307*a* for capping the nozzle opening of the recording head 301 and a suction pump 307*c* connected to the cap 307*a*, and eliminates (removes) thickening things of ink or residual bubbles from the ink discharging unit 301*g* by driving the suction pump 307*c* with the nozzle opening being capped with the cap 307*a*, and then compulsorily sucking out the ink in the recording head 301.

In this suction-recovery operation, since thickening things and residual bubbles are more effectively eliminated as a flow rate of the ink is faster, the flow channel 301*f* has a small size of cross section in order to make the flow rate of the ink faster in the flow channel 301*f*. On the other hand, because the cross section of the filter 301*c* is set as big as possible, the flow channel is formed so that the cross section is decreased below the filter 301*c*.

Though the conventional ink supply system is so far described with an example of the tube supplying manner, the structure below the filter of the recording head in the head integrated manner and the pit-in manner is also basically identical to that of the tube supply manner, only that the structure for supplying ink from the ink tank to the recording tank is different.

On the other hand, in the general color ink-jet recording device, color is formed on the recording medium by subtractive color mixing using cyan ink, magenta ink and yellow ink. Moreover, in order to increase color development of the image, inks for improving gradation such as black ink, light cyan ink, light magenta ink, and light yellow ink and inks for broadening color reproduction such as red ink, green ink, blue ink, orange ink and violet ink are used. Therefore, the ink-jet recording head has an one-color ink drop discharging unit for one head, or, in case of color, a multi-color ink drop discharging unit for one head, and this head is loaded on the ink-jet recording device to realize color printing. Therefore, if the recording head 301 shown in FIG. 10 is for color, the ink discharging units 301*g*, the flow channels 301*f*, the sub tanks 301*b* and the pressure adjustment chambers 322 respectively in the number corresponding to the number of ink colors are installed in the recording head 301 in series.

SUMMARY OF THE INVENTION

However, in case of attaching the elastic member 321 to install the pressure adjustment chamber 322 for the sub tank 301*b* to the recording head 301 like the ink supply system shown in FIG. 10, the elastic member 321 preferably has a rectangular shape to obtain capacity of the elastic member 321 to the maximum. But, since surfaces of the rectangular shape is not fully regular when the inner pressure of the elastic member 321 becomes negative pressure, the elastic member 321 is not transformed to a stable shape. As a result, because the transformed shape of the elastic member 321 irregularly changes, the relation between the reduced air volume in the elastic member 321 and the negative pressure in the pressure adjustment chamber 322 becomes unstable.

In addition, as another problem of the rectangular elastic member 321, there is a phenomenon that the elastic member 321 is interfered with adjacent elastic member 321 when being pressed.

Therefore, an object of the present invention is to provide, in a pressure adjustment chamber using an elastic transformable member mounted for adjusting vapor pressure in a vessel, an elastic member compacted and using the function of the pressure adjustment chamber to the full with a simple structure and low costs, and a compact ink-jet recording head having the pressure adjustment chamber using the elastic member, and an ink-jet recording device having the recording head.

Thus, in order to accomplish the object, the present invention provides a pressure adjustment chamber having at least one elastic transformation body having a changeable volume according to vapor pressure to adjust the vapor pressure in a container communicated thereto and a support for supporting the elastic transformation body to the container, wherein the elastic transformation body includes an approximately circular opening and two surfaces approximately flat before transformation at an outer circumference, in which the two surfaces have a shape extended through a curved portion at a front end opposite to the opening.

In one aspect, the present invention features a pressure adjustment device having a chamber through which vapor enters and exits, at least one elastic transformation body having a changeable volume according to vapor pressure to adjust the vapor pressure communicated with the chamber and a support for supporting the elastic transformation body to the container, wherein the elastic transformation body includes an approximately circular opening and two surfaces approximately flat before transformation at an outer circumference, in which the two surfaces have a shape extended through a curved portion at a front end opposite to the opening.

In other features of the present invention, a recording head includes an ink discharging unit for discharging ink for recording, an ink container for containing air and ink supplied to the ink discharging unit, and a pressure adjustment chamber communicated with the ink container and having at least one elastic transformation body having a changeable volume according to vapor pressure to adjust the vapor pressure in the ink container and a support for supporting the elastic transformation body to the ink container, wherein the elastic transformation body includes an approximately circular opening and two surfaces approximately flat before transformation at an outer circumference, in which the two surfaces have a shape extended through a curved portion at a front end opposite to the opening.

In another features of the present invention, a recording head includes an ink container having a plurality of ink containing chambers arranged in parallel, each of which independently containing ink, an ink discharging unit for discharging ink supplied from the ink container for recording, each of the ink discharging unit corresponding to each ink containing chamber, and a pressure adjustment device installed corresponding to each ink containing chamber for adjusting pressure in the ink container, wherein the pressure adjustment device is arranged over upper portions of at least two ink containers, and the pressure adjustment device includes a plurality of elastic transformation bodies arranged to an arrangement direction of the ink containing chambers and a direction crossing the arrangement direction.

BRIEF DESCRIPTION OF THE PREFERRED EMBODIMENTS

The present invention will hereinafter be described in more detail by the preferred embodiments of the invention.

Figure 1:
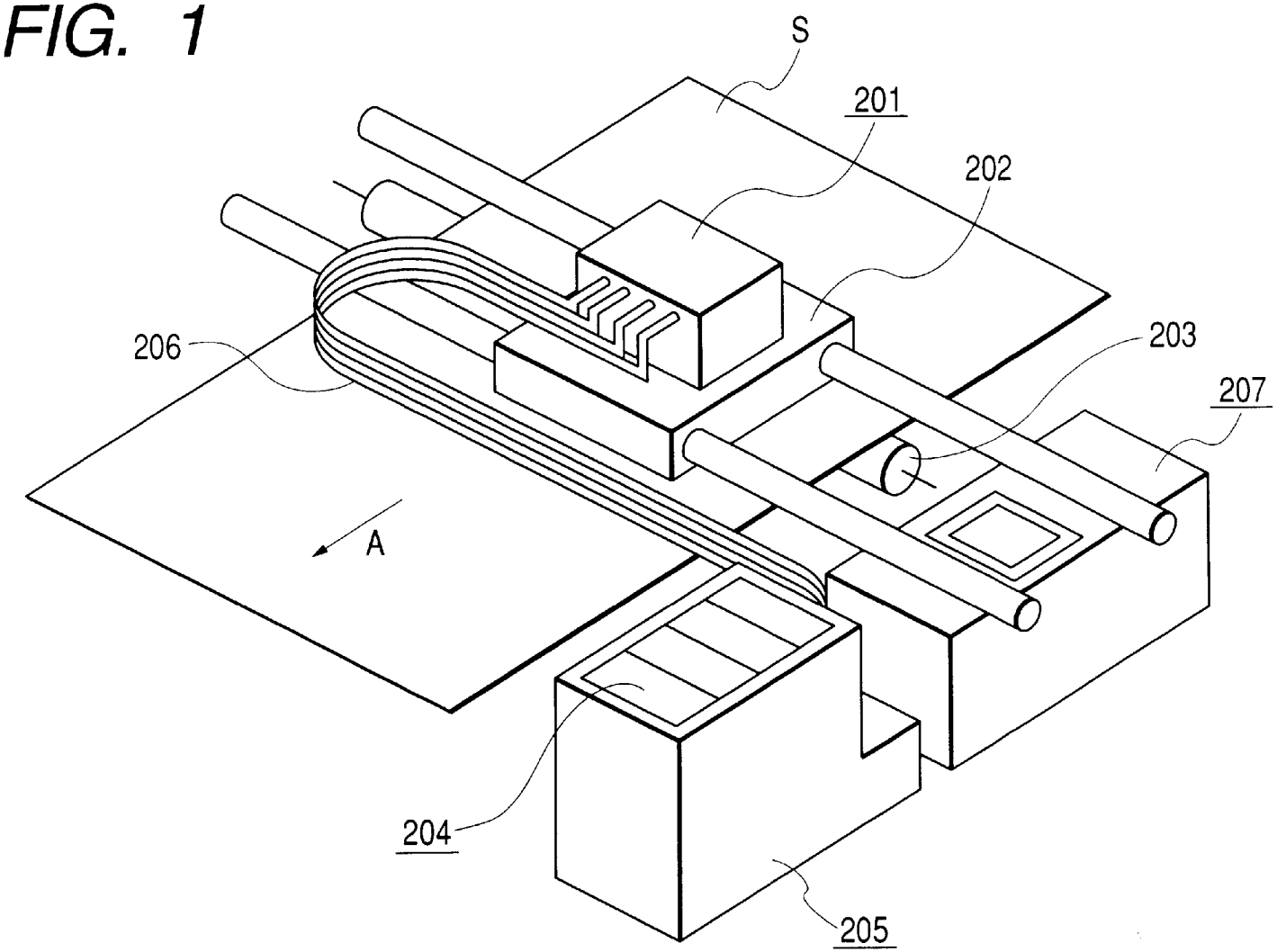
FIG. 1 is a schematic perspective view showing an ink-jet recording device according to an embodiment of the present invention.

FIG. 1 is a schematic perspective view showing an ink-jet recording device according to an embodiment of the present invention.

The ink-jet recording device shown in FIG. 1 is a serial type recording device to form text, symbol, image and so on by selectively discharging ink from a recording head 201 and attaching the ink on a recording sheet S, which is a medium to be recorded, with repeating reciprocation (main scan) of the recording head 201 and carriage (sub scan) of the recording sheet S such as a general recording paper, a special paper, OHP file and so on at each predetermined pitch.

In FIG. 1, the recording head 201 is supported to be slidable along two guide rail, so being detachably loaded on a carriage 202, which reciprocates on a straight line along the guide rail by a not-shown driving means such as a motor. The recording sheet S receiving the ink discharged from an ink discharging unit of the recording head 201 is faced with an ink discharging side of the recording head 201 and carried to a direction crossing a moving direction of the carriage 202 (e.g. an arrow A direction which is an orthogonal direction) to maintain a regular distance from the ink discharging side by a carrying roller 203 as a carrying means.

The recording head 201 has a plurality of nozzle rows for respectively discharging different colors as the ink discharging unit. Corresponding to the ink color discharged from the recording head 201, a plurality of independent main tanks 204 are detachably mounted to ink supply units 205. The ink supply unit 205 and the recording head 201 are respectively connected to a plurality of ink supply units 206 corresponding to each color, and by mounting the main tank 204 to the ink supply unit 205, it is possible to independently supply the ink of each color contained in the main tank 204 to each nozzle row of the recording head 201.

A recovery unit 207 is arranged to face with an ink discharging side of the recording head 201 within a reciprocating range, or in a non-recording area, which is a region except a passing range of the recording sheet S. The recovery unit 207 includes a cap for capping the ink discharging side of the recording head 201, a suction device for compulsorily sucking ink from the recording head 201 with capping the ink discharging side, and a cleaning blade for dispelling pollution on the ink discharging side. The above-described sucking operation is performed by the recovery unit 207 ahead of the recording of the ink-jet recording device.

As a result, in case of operating the ink-jet recording device after leaving alone for a long time, the recovery unit 207 sucks high density ink residing at a bottom of the main tank 204, and when recording is actually made, the ink stirred to have stable density is used. Therefore, though the ink-jet recording device has not been used for a long time and pigment components in the ink or minute resin particles for improving fixation of the recording sheet S are deposited at the bottom of the ink tank 204, it is possible to form a high quality image with stable density of these pigment components and minute resin particles.

Though described here as an example of the serial type ink-jet recording device, the present invention may applied to an ink-jet recording device having a line-type ink-jet recording head in which nozzle rows are installed throughout overall width of the recording medium, if having a suction means of the recording head.

Figure 2:
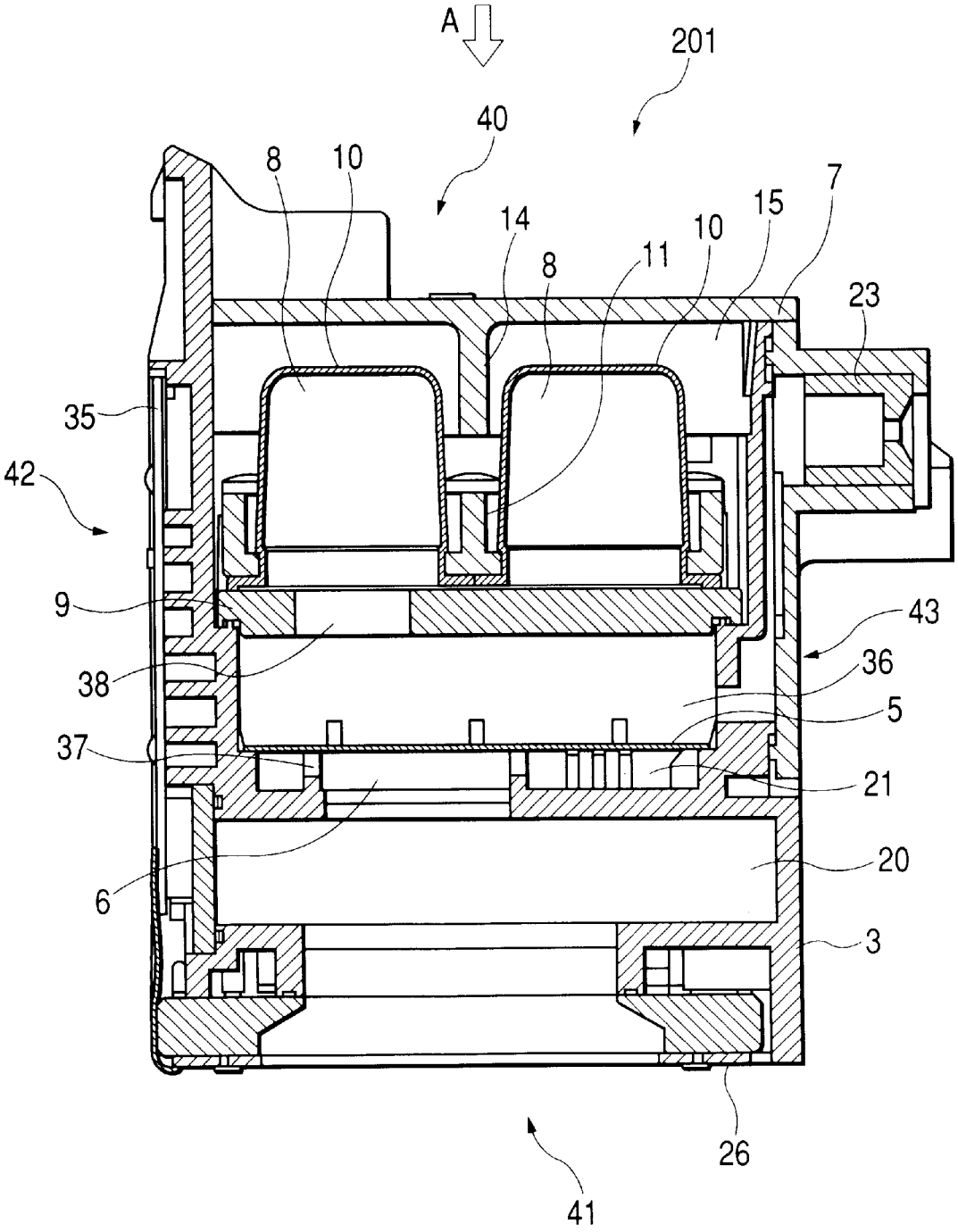
FIG. 2 is a side sectional view showing a recording head loaded on a carriage shown in FIG. 1.
Figure 3:
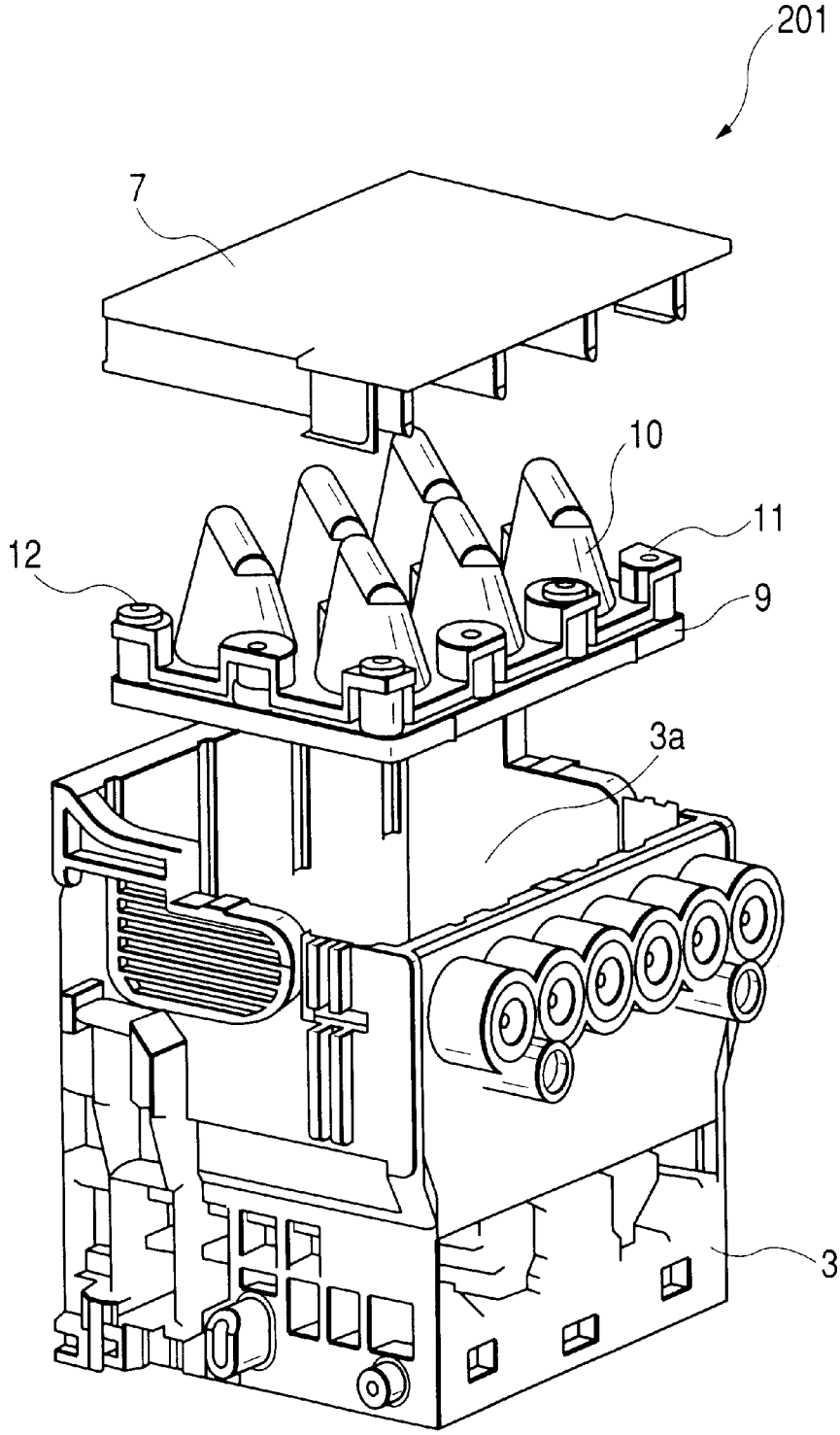
FIG. 3 is a partially exploded perspective view showing the recording head.
Figure 4:
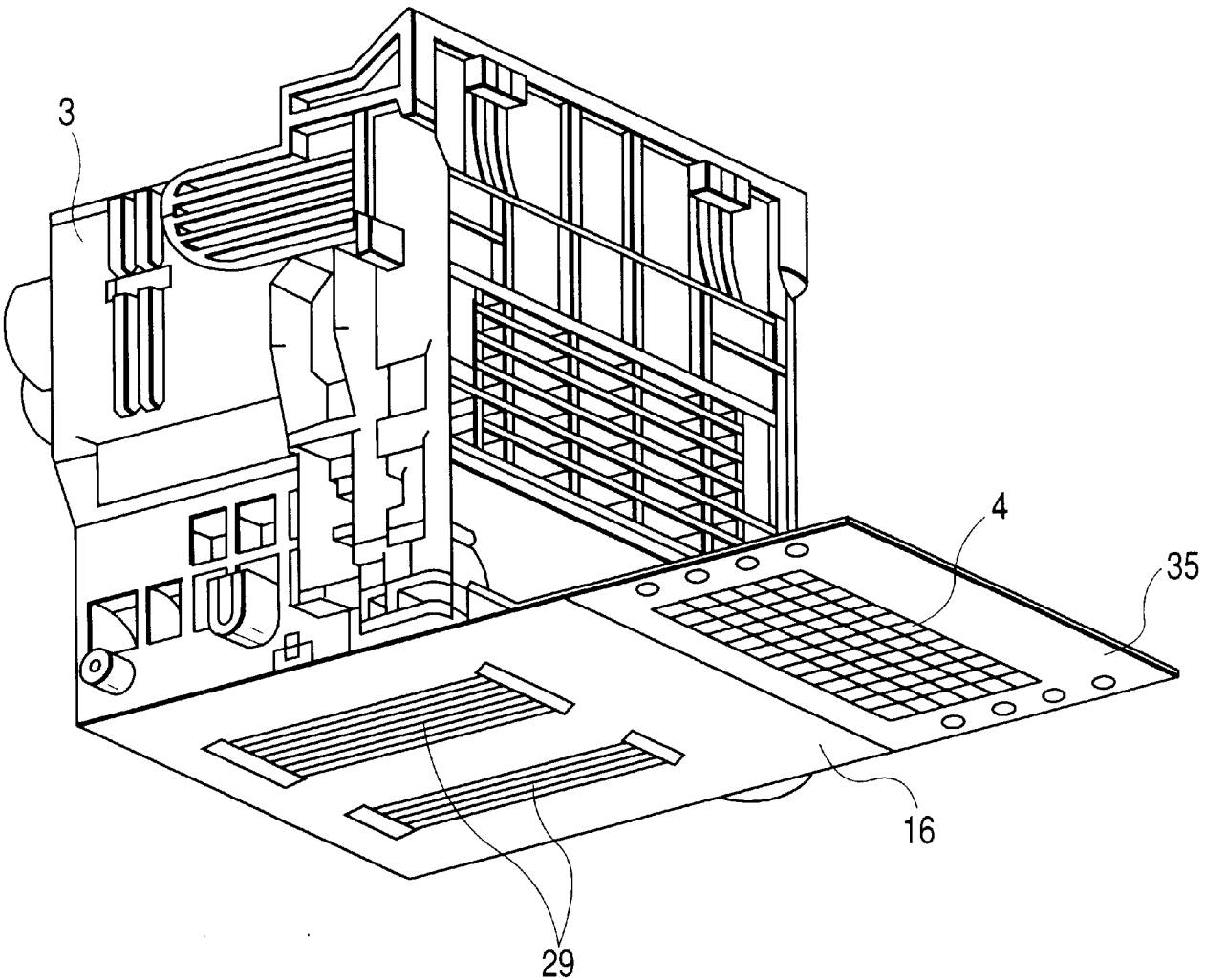
FIG. 4 is a perspective view showing the recording head in a state before a head board is attached to a front surface of the recording head.
Figure 5A:
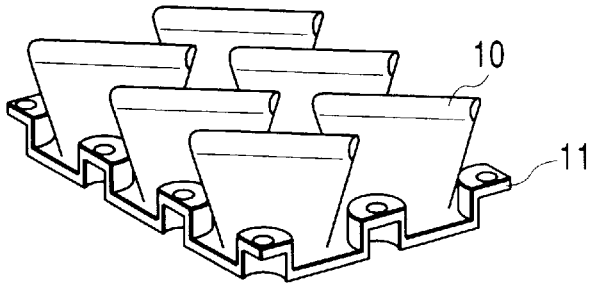
FIGS. 5A, 5B and 5C are perspective views showing an elastic member, a push member and a sub tank cover provided to the recording head.
Figure 5B:
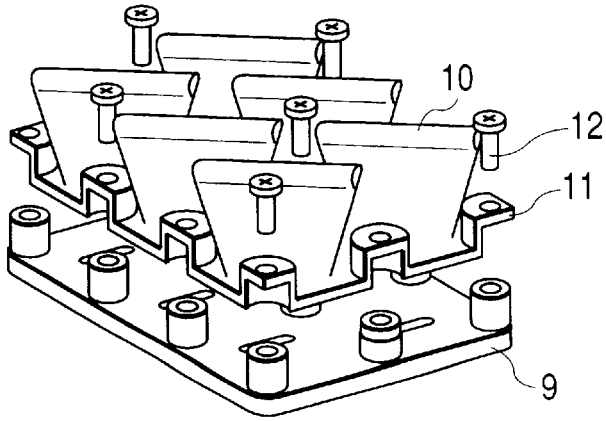
Figure 5C:
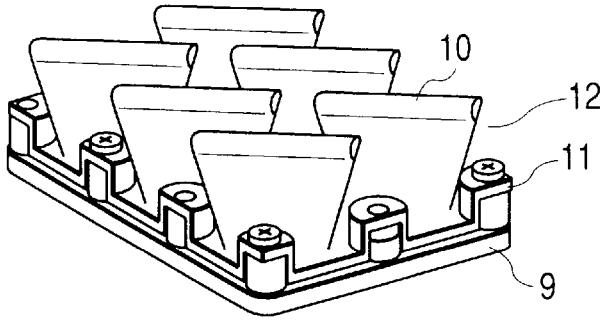
Figure 6:
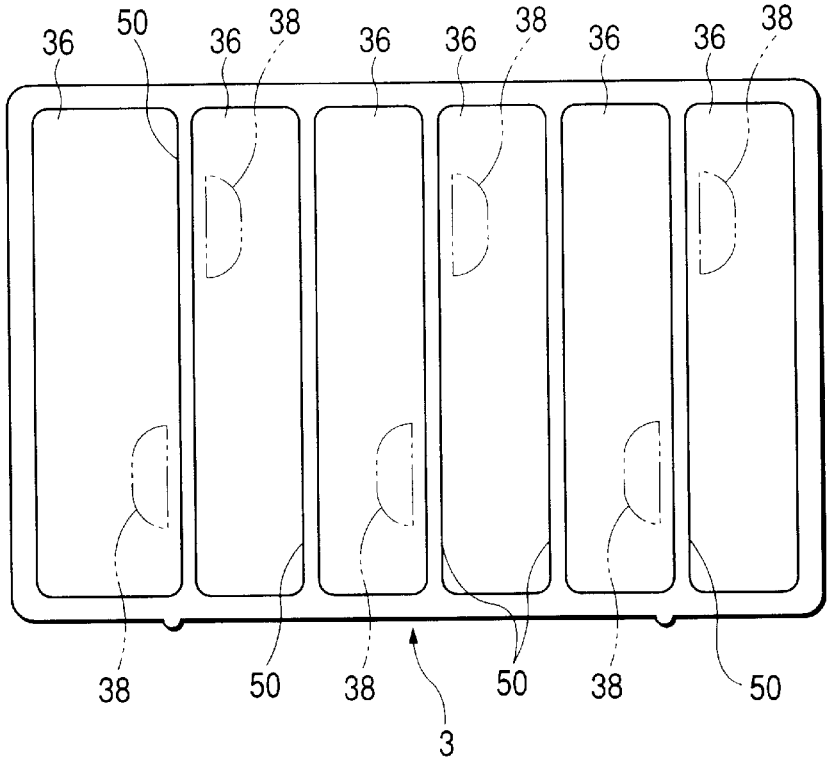
FIG. 6 is a plane view showing arrangement of a plurality of sub tanks in the recording head.
Figure 7:
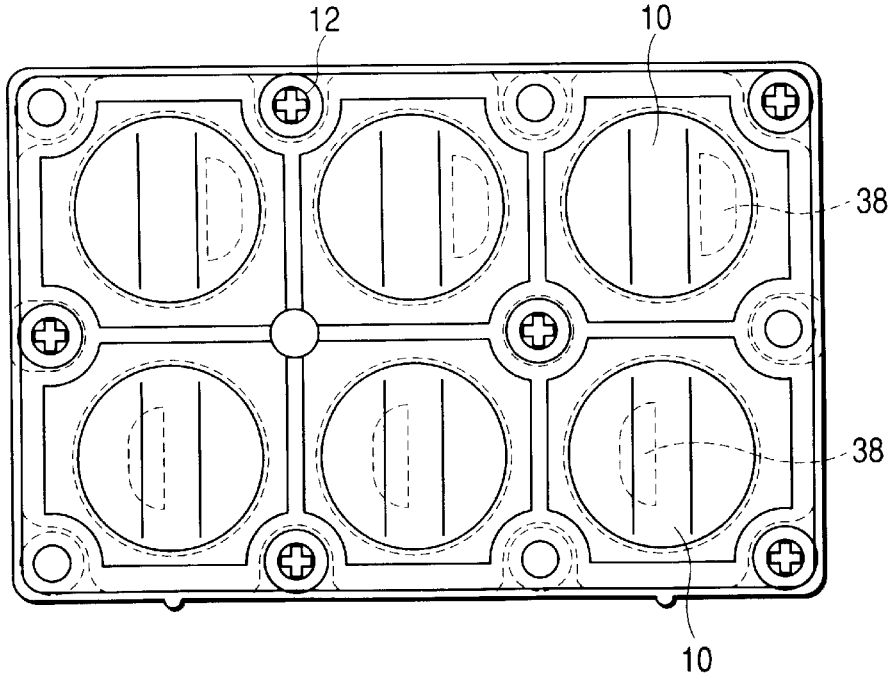
FIG. 7 is a plane view showing a state that the elastic member and the sub tank cover are mounted to a head body.

FIG. 2 is a side sectional view showing the recording head 201 loaded on the carriage 202 shown in FIG. 1. FIG. 3 is a partially exploded perspective view showing the recording head 201. FIG. 4 is a perspective view showing the recording head 201 in a state before a head board is attached to a front surface of the recording head. FIGS. 5A, 5B and 5C are perspective views showing an elastic member, a push member and a sub tank cover provided to the recording head 201 according to one embodiment. FIG. 5A is a perspective view of the elastic member and the push member. FIG. 5B is an exploded perspective view of them. FIG. 5C is a perspective view showing the state that a plurality of elastic members are mounted to the sub tank cover by using the push member and an attachment screw. FIG. 6 is a plane view showing arrangement of a plurality of sub tanks in the recording head 201. FIG. 7 is a plane view showing a state that the elastic member and the sub tank cover are mounted to a head body.

A shape of the recording head 201 of this embodiment is generally constituted with 6 surfaces of upper surface 40, bottom surface 41, front surface 42, rear surface 43, right surface and left surface, all of which are integrally formed except the upper surface 40. And, the recording head 201 of this embodiment may discharge 6 color inks, and the color inks are divided by partitions 50 of a head body 3 through needles of needle maintaining members connected to each color needle container 23, as shown in FIG. 6, so as to supply the ink to each of 6 sub tanks 36 formed as an ink container. The ink supplied to the sub tank 36 is temporarily stored in an ink storage 21 through a filter 5 for filtering the ink by eliminating impurities (foreign matters) in the ink. And, the ink is flowed in an ink supply liquid chamber 20 through a communication path 37 and a flow channel 6. The ink flowed in the liquid chamber 20 is discharged from a plurality of discharging holes 29 arranged in parallel for each color as shown in FIG. 4 by bubbling energy generated by a not-shown electric-thermal converting unit, which converts electric energy supplied from a heater board 26 installed on the lower surface 41 into thermal energy. To the heater board 26, a plurality of ink discharging units consisting of nozzle rows are installed corresponding to each color, or corresponding to each sub tank 36, and front ends of each nozzle are opened on a surface of the heater board 26 as a discharging hole 29.

Above a plurality of the sub tank 36, a plurality of pressure adjustment chambers 8 communicated with the sub tank 36 through air holes 38 formed as opening to a sub tank cap 9 to absorb abrupt change of pressure in the sub tank 36 formed by an elastic member like rubber as the elastic transformable unit are installed corresponding to each sub tank 36. Though a plurality of independent elastic members 10 corresponding each sub tank 36 are used to form a plurality of the pressure adjustment chambers 8, a plurality of the pressure adjustment chambers 8 may be also formed by using an integrated shape, or an elastic member shaped to have a plurality of elastic transformable units. Each elastic member 10 has a dome shape, and the pressure adjustment chamber 8, which is a space surrounded by the elastic members 8, has a function of adjusting pressure in the sub tank 36 as described below by changing volume according to transformation of the elastic member 10 caused by pressure in the sub tank 36.

Figure 8:
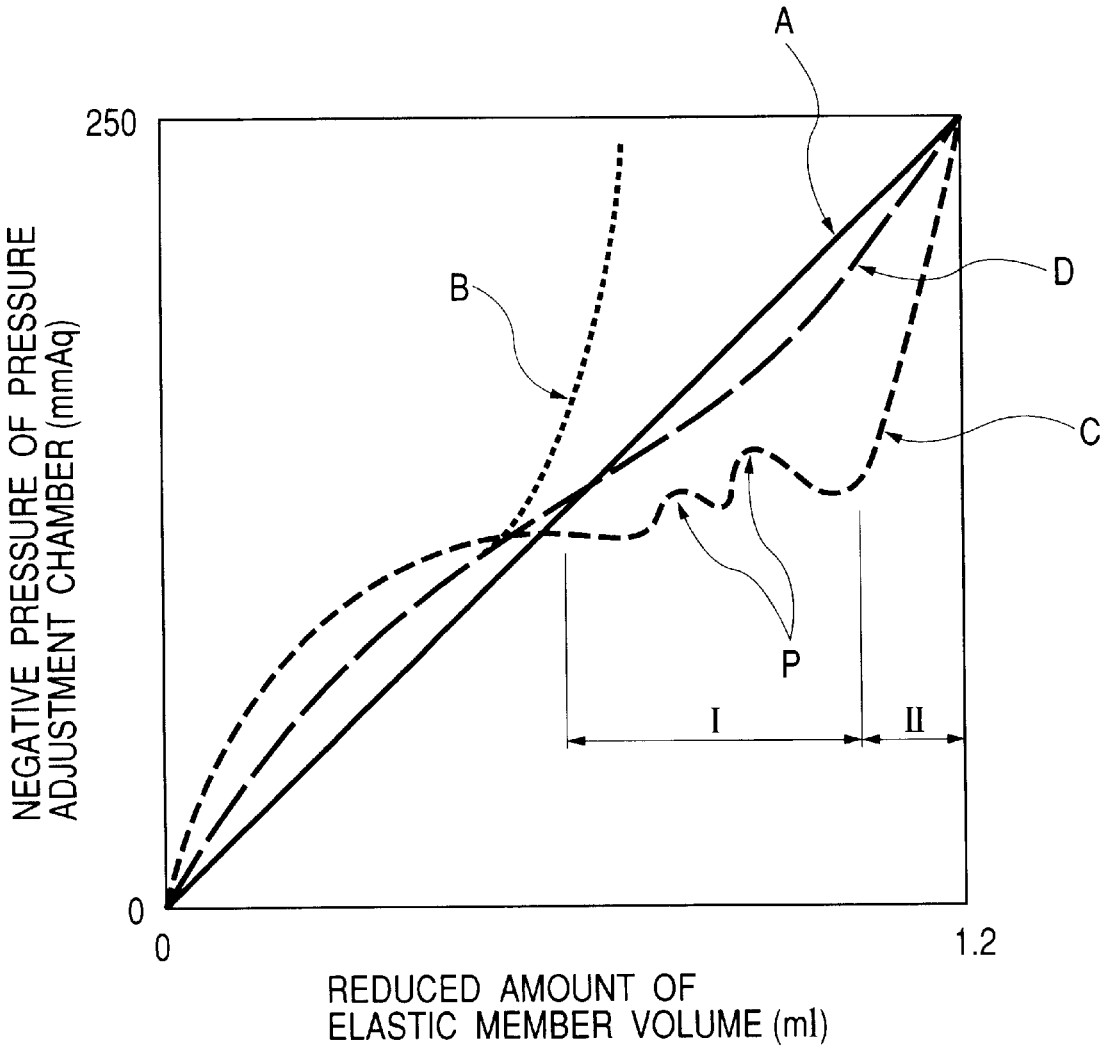
FIG. 8 is a graph for illustrating characteristics of the elastic member mounted to a pressure adjustment chamber.

The above description is illustrated with use of FIG. 8. But, numerical values in X and Y axes are just an example, and the present invention is not limited to those values. FIGS. 11A to 11D show representative examples of the rectangular elastic transformable body used for illustrating FIG. 8. But, it should not be considered that only such a shape is suitable for the present invention.

In FIG. 8, a straight line A denotes the case that a reduced air volume in the elastic transformable body is in an ideal relation to the negative pressure in the vapor pressure adjustment chamber. After all, if the volume in the elastic transformable body is decreased, the pressure in the vapor pressure adjustment chamber is increased so as to realize the ideal relation. In this case, if the negative pressure in the vapor pressure adjustment chamber is reduced, the volume in the elastic transformable body is accordingly increased. As described, if the volume change in the elastic transformable body and the negative pressure in the vapor pressure adjustment chamber are in hysteretic relation, the vapor pressure adjustment chamber shows more stable response to pressure change in the communication chamber, so stabilizing the ink supplying state to the ink discharging unit, and therefore rarely effecting to a printed image.

However, if the elastic transformable body is hardly deflated at a certain point, the negative pressure in the vapor pressure adjustment chamber is abruptly increased as shown with a curve B. Then, because the ink supply to the ink discharging unit cannot catch up ink consumption by printing, so anxiously having an bad influence on the printed image like deteriorating the printing density, it is required to stop discharging the ink from the ink discharging unit until the negative pressure in the vapor pressure adjustment chamber is decreased. If the negative pressure increases more in disregard of that, air is penetrated into the nozzle of the ink discharging unit from atmosphere, so to become a non-discharging state, which does not discharge ink from the nozzle.

Figure 11A:
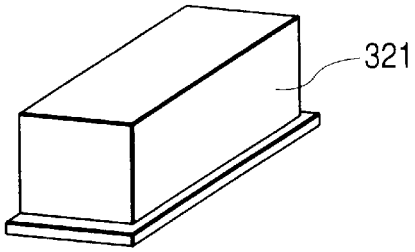
FIGS. 11A, 11B, 11C and 11D show representative examples of a rectangular elastic transformable body used for illustrating FIG. 8.
Figure 11B:
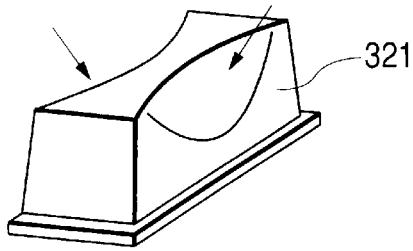
Figure 11C:
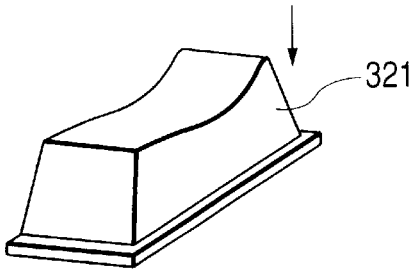

FIG. 11B shows an example of the case that the rectangular elastic transformable body 321 shown in FIG. 11A is deflated from a side of a longitudinal direction to an arrowed direction. And, FIG. 11C shows an example of the case of being inflated from an upper surface of the elastic transformable body 321 to an arrowed direction. In such cases, there can be a point from which the deflation is not easy, and at this time, the curve B in FIG. 8 is applied.

And, if the elastic transformable body 321 becomes unstable because of being not easily deflated or too easily deflated from a certain point, the negative pressure in the vapor pressure adjustment chamber 322 becomes unstable like to have several inflection points in an interval I as shown in the curve C, and finally the negative pressure abruptly increases in an interval II. In this case, the ink supply to the ink discharging unit 301*g* becomes unstable resulting the print image is distorted, and lead to a state of being not capable of ink discharging finally. The elastic transformable body 321 having such a characteristic however does not have stable response to pressure change in the communication chamber because it is not considered that the volume of the elastic transformable body 321 is increased as the negative pressure in the vapor pressure adjustment chamber 322 is reduced.

Figure 11D:
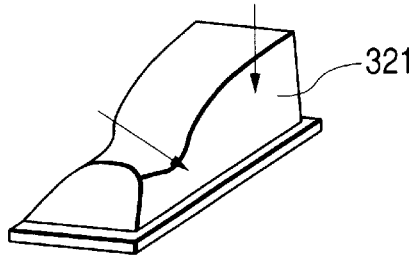
Figure 12A:
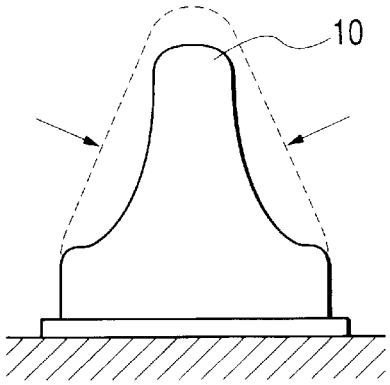
FIGS. 12A and 12B are schematic views showing a transformed state of the elastic member shown in FIGS. 9A and 9B.
Figure 12B:
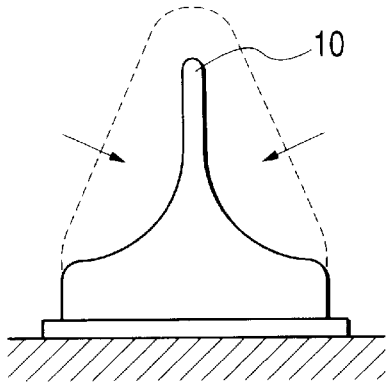
Figure 13:
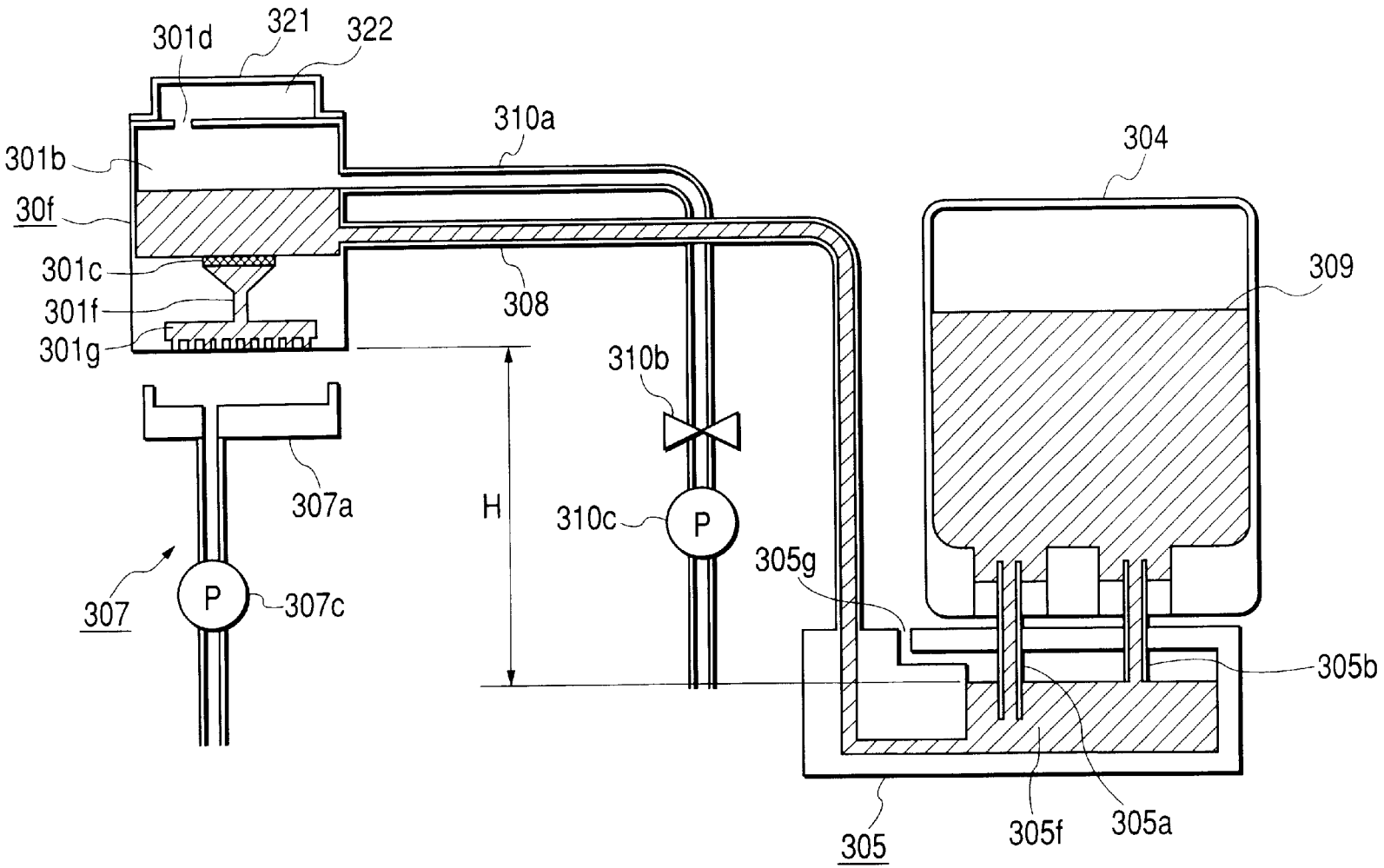
FIG. 13 is a schematic view showing an ink supply system of a conventional ink-jet recording device in a tube supplying manner.

FIG. 11D shows an example of the case that the elastic transformable body 321 is deflated from the arrowed direction. In this case, the deflation is started from the upper surface direction as shown in FIG. 11C, and additionally from the side of the lateral direction. This side falls on interval I of the curve C shown in FIG. 8. Finally, it becomes difficult to compress, and abruptly rise the negative pressure as shown in the interval II of the curve C. At this time, it considered that the difference of compressing deformation between the upper surface direction and the lower surface direction shows as inflection point P in the interval I of the curve C shown in FIG. 8.

In the present invention, the elastic member 321 is selected conforming to the straight line A or, the curve D approximately equal to the straight line A. And, this elastic member shows well about an elastic member having a characteristic of the straight line A or the curve D, and at the end an elastic member having a stable hysteresis.

Figure 9A:
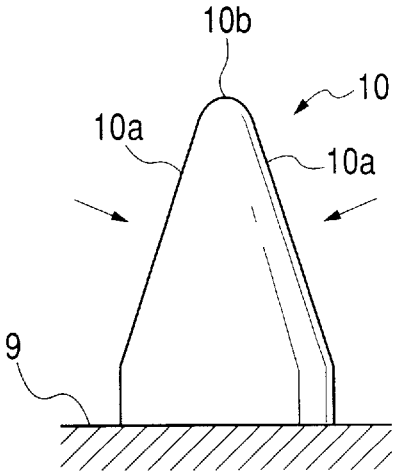
FIGS. 9A and 9B are side and plane views showing a shape of an elastic transformable body according to one embodiment.
Figure 9B:
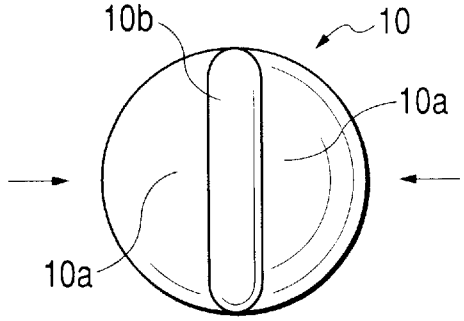
Figure 10A:
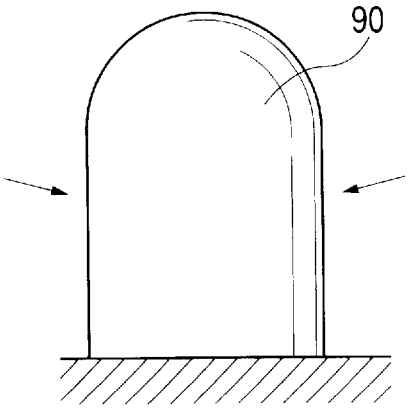
FIGS. 10A and 10B are side and plane views showing a shape of an elastic transformable body according to a comparative example.
Figure 10B:
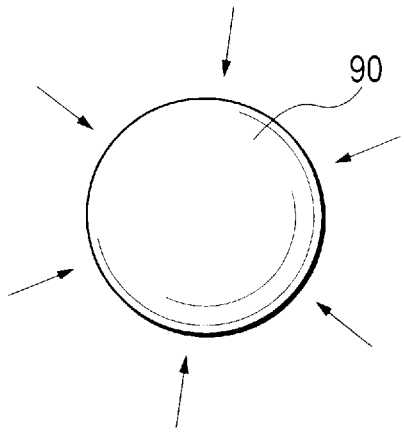

FIG. 9A is a side view showing an example of the elastic transformable body 10, and FIG. 9B is a plane view of the elastic transformable body 10. FIG. 10A is a side view showing a comparative example of the elastic transformable body 10, and FIG. 10B is a plane view of the comparative example.

At first, in order to arrange the recording heads 201 compact, it is preferred that the vapor pressure adjustment chamber has a rectangular shape to ensure a required volume. However, as described above, the rectangular shape is not suitable for getting a stable negative pressure characteristic.

Next, to ensure a big volume, there are proposed a "dome shape" in which the elastic transformable body 90 has a cylindrical shape and a front end of the elastic transformable body 90 has a semi-circular shape. Like that, in case that the elastic transformable body 90 has no flat surface on an outer circumference, the negative pressure in the vapor pressure adjustment chamber is not stabilized because a first-crushed position is not regular and crushed shape is not definite. This configuration is not easily pulled in view of the inner side because the inner side of the "dome shape" elastic transformable body 90 is convex and concave. Therefore, if there is no "catalyst or trigger (cause)" such as that "a wall thickness is thicker than others" or "having a fold line", it is not willing to be crushed inward. It is thought that such a phenomenon happens because this "catalyst or trigger" is different according to circumstances.

In order to improve such a phenomenon, a recession or a flat surface may be formed at a part of the elastic transformable body. By using such a shape, it is possible that the elastic transformable body surely starts transformation from a certain position.

However, though the deflation makes it possible to obtain a regular change of state, in case that the pressure in the vapor pressure adjustment chamber is increased, of the condition changes to decrease "the volume reduction of the elastic transformable" (closer to 0 value) as shown in FIG. 8, the transformation state is not always regular when the deflated elastic transformable body is recovered. The reason is that the inner side is shaped to have many places easily pressed out.

Therefore, as shown in FIGS. 9A and 9B, the bottom of the sub tank 9, or the opening, has a circular shape to exhibit the above function of the vapor pressure adjustment chamber 8 to the maximum. The elastic transformable body 10 is extended from the sub tank 9 upward so that the section area of the vapor pressure adjustment chamber 8 is decreased upward from the bottom and so that the elastic transformable body 10 has two flat surfaces 10*a* on the outer circumference symmetrically to a line passing through a center of the bottom when viewing the elastic transformable body 10 from an upper surface. These two flat surfaces 10*a* are flat in state before the elastic transformable body 10 is transformed, and connected through a front end 10*b* connected in a line parallel to the bottom of the elastic transformable body 10. That is, before transformation, the elastic transformable body 10 has a so-called "cape chisel like" shape, and the front end 10*b* becomes a curved surface. Therefore, two flat surface 10*a* have the same angle to the bottom of the front end 10*b*, and a space between the flat surfaces 10*a* is gradually decreased from the bottom of the elastic transformable body 10 to above the front end 10*b*. A length of the front end 10*b* parallel to the bottom of the elastic transformable body 10 may be nearly equal to or longer than a diameter of the bottom, but preferably longer so as to increase the volume of the vapor pressure adjustment chamber 8.

In the elastic transformable chamber 10 of such a shape, when the elastic transformable chamber 10 is transformed to reduce the volume of the vapor pressure adjustment chamber 8, centers of the flat surfaces 10*a* become dented from the flat surfaces 10*a* to be closer. At this time, the elastic transformable body 10 is surely crushed from the flat surfaces 10*a* because of having two flat surfaces 10*a* on the outer circumference. Moreover, these flat surfaces 10*a* may actively set a transformed position by forming a recession at a near center. In addition, the negative pressure characteristic becomes stable because the crushed shape of the elastic transformable body 10 is nearly regular, and the recovering phenomenon is nearly regular since the flat surfaces 10*a* are nearly symmetrically installed on center of the front end 10*b*.

In this embodiment, a plurality of the elastic transformable bodies 10 are arranged to a direction of the arrangement of the sub tanks 36 as well as a crossing direction in order to ensure sufficient volume of the vapor pressure adjustment chamber 9 and mount the elastic transformable body 10 having a shape of stabilizing the negative pressure in the vapor pressure adjustment chamber 8 to the sub tank 9. That is, the head body 3 is provided with a wall to form a plurality of the sub tanks 36, and a tank with the sub tank cap 9, and the inner of the tank is divided into 6 sub tanks 36 by 5 partitions 50. And, a plurality of elastic members 10 are mounted to an upper wall of the tank to cover each air holes 38, and the vapor pressure adjustment chamber 8 on the sub tanks 36 is divided into a direction of arrangement of the sub tanks 36 as well as a direction crossing the arrangement direction. By such an arrangement of the elastic transformable bodies 10, each elastic transformable body 10 may be arranged over upper portions of at least two sub tanks 36, and as a result, the elastic transformable body 10 may have a larger diameter for a narrow sub tank 35 or a sub tank 35 having a limited width. In addition, in order to realize such an arrangement of the elastic transformable bodies 10, the air holes 38 are arranged in zigzags as shown in FIGS. 6 and 7. Each air hole 38 preferably has a half moon shape since each elastic transformable body 10 is put over the upper portions of two sub tanks 36.

And, in order to protect the elastic member 10, a sub tank cover 7 is mounted to the upper portion of the elastic member 10. The sub tank cover 7 includes a rib 15 integrated with the sub tank cover 7 to extend from a front side 42 toward a rear side 43, and a reinforcing rib 14 integrated with the sub tank cover 7 to extend to a direction crossing the rib 15. This rib 15 has a function of improving rigidity of the recording head 201 to a front-to-back direction from the front side 42 to the rear side 43, together with the partitions 50 dividing the sub tank 36, the ink storage 21, the flow channel 6 and the ink supplying liquid chamber 20 for each color. And, the right-to-left rigidity perpendicular to the side of the recording head 201 is obtained by the reinforcing rib 14 and the sub tank cap 9 of the sub tank cover 7.

As shown in FIGS. 3, 5A and 5B, each elastic member 10 is mounted to the sub tank 9 by the sub tank cap 9 or a plurality of attachment screw 12 so that a plurality of elastic members 10 may be pressed down on the sub tank cap 9 by a push member 11. As shown in FIG. 3, a plurality of the elastic members 10 assembled to the sub tank cap 9 are inserted to concave portions 3*a* of the head body 3, and thereby a plurality of sub tanks 36 are formed to the recording head 201. As shown in FIG. 6, a plurality of the partitions 50 are formed to the head body 3 so that a plurality of the sub tanks 36 are arranged in parallel, and each sub tank 36 has a rectangular shape extended to a direction crossing the arrangement direction. And, a plurality of the air holes 38 corresponding to each sub tank 36 are formed to the sub tank cap 9, and each air hole 38 is communicated with the corresponding sub tank 36. A plurality of these air holes 38 are arranged in zigzags so as to arrange a plurality of the elastic members to an arrangement direction of the sub tanks 36 and a direction orthogonal to, that is crossing, the arrangement direction.

And, the partition 50 is integrated with a cartridge body 3 to connect the front side 42 and the rear side 43. And, because a longitudinal direction of the partition 50 is nearly orthogonal to a scanning direction of the carriage 202, the shaking of the ink in the sub tank 36 due to the vibration of the carriage in main scan, or in the ink supply liquid chamber 20 can be restrained to the minimum.

When the recording device body is installed to the rear side 43 of a needle receiving unit 23 of the recording head 201, a head board 35 is attached to the front side 42, which is an inner side. This head board 35 is pressed to a plurality of electrodes installed in the carriage 202 so that a plurality of the electrically connected electrodes 4 are installed as shown in FIG. 4. The head board 35 is electrically connected to a heater board 26 by a flexible board 16 as shown in FIG. 4.

Now, operations of the vapor pressure adjustment chamber 8 are described in detail.

The vapor pressure adjustment chamber 8 is a room of which volume is decreased according to increase of the inner negative pressure, and in case that the vapor pressure adjustment chamber 8 is made of the elastic transformable body 10 like the embodiment, a rubber material is preferably used for the elastic transformable body 10. Besides the elastic transformable body 10, plastic sheet and spring association may be also used.

Figure 21A:
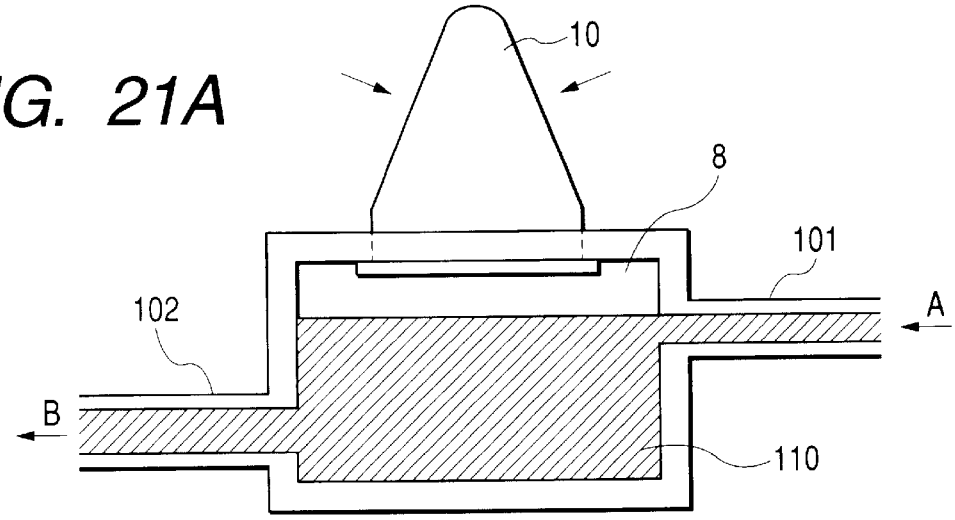
FIGS. 21A, 21B and 21C are concept views showing a function of a vapor pressure adjustment chamber using the elastic transformable body.
Figure 21B:
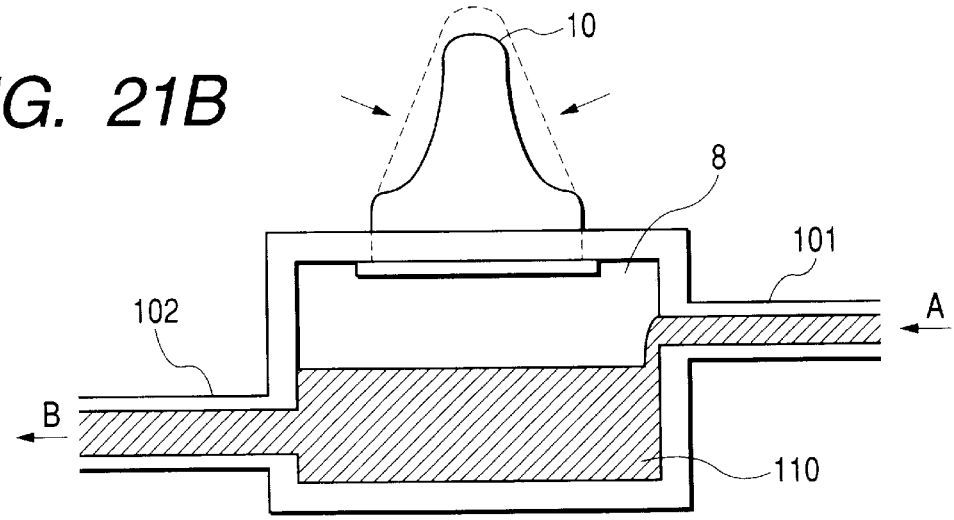
Figure 21C:
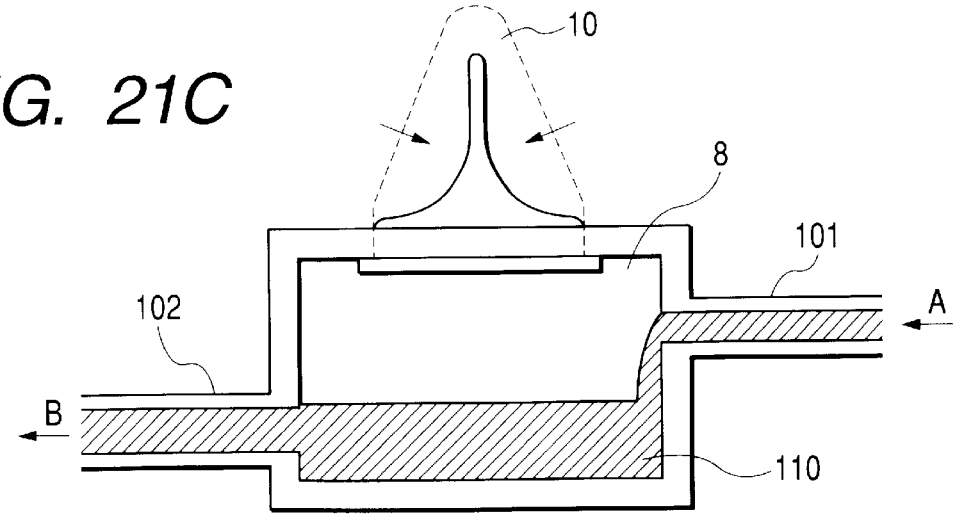

FIGS. 21A, 21B and 21C are concept views showing a function of the vapor pressure adjustment chamber 8 using the elastic transformable body 10. In the vapor pressure adjustment chamber 8, a liquid inject pipe 101 and a liquid supply pipe 102 are arranged as shown in the figures. The liquid 110 injected into the pressure adjustment chamber 8 through the liquid supply pipe 101 from an arrow direction A is supplied to an arrow direction B by the liquid supply pipe 102. In the present invention, the liquid supply pipe 102 has a diameter larger than the liquid inject pipe 101 as shown in the figures. This is applied to the case that there is an equipment that consumes a large amount of liquid in a moment at a front end of the liquid supply pipe 102, and in some cases, two pipes may have same diameter.

FIG. 21A shows an initial state that the vapor pressure adjustment chamber 8 is filled with the liquid 110.

FIG. 21B shows the state that a large amount of the liquid 110 is instantaneously supplied through the liquid supply pipe 102. Because an amount of the liquid 110 injected from the liquid inject pipe 101 is larger than an amount of the liquid 110 supplied from the liquid supply pipe 102, the liquid amount in the vapor pressure adjustment chamber 8 is decreased. At this time, the deflated volume of the elastic transformable body 10 is corresponding to a decreased liquid amount in the vapor pressure adjustment chamber 8. By such a behavior, though the supplied amount of the liquid 110 from the liquid supply pipe 102 exceeds the injected amount of the liquid 110 from the liquid inject pipe 101 in an instant, a supplied amount per unit time is not changed.

FIG. 21C shows a limited state that the liquid 110 supply by the liquid supply pipe 102 is possible without changing the supply amount of a unit time. Therefore, when injecting the liquid 110 from the liquid inject pipe 101 to the pressure adjustment chamber 8, the liquid 110 can be supplied by the liquid supply pipe 102 without changing the supply amount of a unit time. As a result, it may be performed while the supply of the liquid 110 from the liquid supply pipe 102. At this time, it is important that the elastic transformable body 10 recovers to hysteresis. If it cannot recover, not only the inject amount of the liquid from the liquid inject pipe 101 becomes unstable, but also time and number to possibly supply the liquid without changing the supply amount of a unit time become unstable. If using the elastic transformable body 10 of the present invention, it becomes possible that the state changes between the states shown in FIGS. 21A, 21B and 21C are performed in hysteresis.

The pressure adjustment chamber 8 used in this example is separated from the elastic transformable body, but the function of the present invention may be fulfilled though they are identical.

Though explained with an example of the liquid in the example, the same effects may be obtained when using the vapor.

The volume of the vapor pressure adjustment chamber 8 is set according to a temperature of circumstance where the recording head 201 is used and a volume of the sub tank 36, it is set to about 0.5 ml in this embodiment.

If not installing the vapor pressure adjustment chamber 8, the pressure in the sub tank 36 is directly affected by the pressure loss when the ink passes through the main tank 204, the ink supply unit 205 and the ink supply tube 206. For that reason, in case of so-called high duty discharging in which the ink is discharged in a high proportion to total nozzle number like all nozzles of the recording head 201 discharges the ink, the ink supplied to the recording head 201 becomes insufficient for the discharged ink, and the negative pressure becomes abruptly increased. If the negative pressure in the nozzles of the recording head 201 exceeds the −200 mmAq of limit value (about −2.027 kPa: unless the specific gravity of the ink≃the specific gravity of water), unfavorable conditions to image forming, which cause that the discharging becomes unstable, printing becomes scattered and the like occur.

In the serial type recording device like the present embodiment, there exists a state of stopping the ink discharging when the carriage 202 (see FIG. 1) reverses, despite of image forming in the high duty discharging. By using this, the vapor pressure adjustment chamber 8 acts as a condenser to relax an increase time of the negative pressure in the sub tank 36 by reducing the volume during discharging the ink, and to recover the increase time of the negative pressure through the ink supply tube 206.

For example, assume the case that, when a changing proportion of the negative pressure for the volume decrease of the vapor pressure adjustment chamber 8 is $K=-1.013$ kPa/ml and the volume of the sub tank 36 is $Vs=2$ ml, the supplied ink is sufficient for the discharged ink as much as $\Delta V=0.05$ ml. In this case, if there is no vapor pressure adjustment chamber 8, the negative pressure change in the sub tank 36 becomes $\Delta P=Vs/(Vs+\Delta V)-1=-2.471$ kPa owing to "PV is constant", and because of exceeding the above-described limit, the discharging becomes unstable. For that, if there is the vapor pressure adjustment chamber 8, it becomes $\Delta P=K\times\Delta V=-0.051$ kPa, so that the negative pressure increase becomes restrained and the stable discharging becomes possible.

And, if not using the recording head 201 for a long time with capping the ink discharging side by the cap of the recovery unit 207, the pressure in the sub tank 36 increases due to thermal expansion of the vapor or increase of thermal pressure in the sub tank 36, as for the temperature. As a result, the ink is leaked from the nozzles of the recording head 201 or returned to the ink tank 204 so as to be separated from the ink in the sub tank 36.

In this case, the thermal expansion of vapor and the increase of vapor pressure in the sub tank 36 are absorbed by enlarging the volume of the vapor pressure adjustment chamber 8 with movement of the elastic transformable body 10. After that, the negative pressure in the sub tank 36 is recovered to a normal value by compulsorily sucking the ink from the recording head 201 with use of the ink suction device with capping the ink discharging side before opening the cap of the recovery unit 207. As a result, it becomes possible to ensure stable printing.

As described above, the ink discharging becomes stable by the vapor pressure adjustment chamber 8 and the effect of the pressure loss in the ink supply line from the main tank 204 to the recording head 201 is restrained. For those, the ink supply tube 206 driven by the carriage 202 may have a small diameter by adjusting material of the vapor pressure adjustment chamber 8, and it becomes possible to contribute to load decrease for the movement of the carriage 202.

In this embodiment, a plurality of the elastic members 10 are arranged not only to an arrangement direction of the sub tanks 36 but also to a direction crossing the arrangement direction in order to mount the elastic member 10 having a shape of stabilizing the negative pressure of the vapor pressure adjustment chamber 8 to the sub tank 9 after obtaining the volume of the vapor pressure adjustment chamber 8 sufficiently. That is, the vapor pressure adjustment chamber 8 on the sub tank 36 is divided to the arrangement direction of the sub tank 36 and the direction crossing the arrangement direction, respectively. By such an arrangement of the elastic members 10, the vapor pressure adjustment chamber 8 on the sub tanks 36 is divided into a direction of arrangement of the sub tanks 36 as well as a direction crossing the arrangement direction. By such an arrangement of the elastic transformable bodies 10, each elastic transformable body 10 may be arranged over upper portions of at least two sub tanks 36, and as a result, the elastic transformable body 10 may have a larger diameter for a narrow sub tank 35 or a sub tank 35 having a limited width. In addition, in order to realize such an arrangement of the elastic transformable bodies 10, the air holes 38 are arranged in zigzags as shown in FIGS. 6 and 7. Each air hole 38 preferably has a half moon shape since each elastic transformable body 10 is put over the upper portions of two sub tanks 36.

In FIG. 7, the elastic transformable body 10 is arranged that the front end 10*b* of each elastic transformable body 10 is orthogonal to the arrangement direction of the sub tank 36. As a result, the length of the front end 10*b* is bigger than the diameter of the bottom surface of the elastic transformable body 10 so that if the elastic transformable body 10*b* is set to have bigger volume, each front end 10*b* may be inclined to the arrangement direction as shown in FIGS. 3 and 5A to 5C. The angle of each front end 10*b* to the arrangement direction of sub tank 36 may be set so that the attachment screw 12 can be easily combined, according to the relative position of the attachment screw and the elastic transformable body 10. In the example shown in FIG. 7, each elastic transformable body 10 is arranged for easy combination of the attachment screw 12.

In this case, the shape of the elastic transformable body 10 is not limited to the shown one. The elastic transformable body 10 may have any shape, if the transformation of the elastic transformable body 10 is stable and regular and the function of the vapor pressure adjustment chamber 8 is sufficiently exhibited. And, a size of the elastic transformable body 10 can be suitably determined depending on configuration of the recording head 201 and the ink supply system.

As described above, in the configuration that the elastic transformable members 10 are arranged to the arrangement direction of the sub tanks 36 and the direction crossing the arrangement direction, though the width of each sub tank 36 is decreased, the negative pressure of the pressure adjustment chamber 8 is stabilized and the elastic member 10 obtaining sufficient volume can be installed corresponding to each sub tank 36. Therefore, the recording head 201 having a plurality of sub tanks 36 can be received in compact and it is possible for the pressure adjustment chamber 8 to show its function to the maximum. And, according to the compact recording head 201, the ink-jet recording device body is also configured in compact, which is preferable for users as a product, and it is also possible to lower the cost of the recording head 201 and the ink-jet recording device down.

Now, the ink supply unit 205 and the main tank 204 are described with reference to FIG. 14.

The main tank 204 is detachable to the supply unit 205, and has an ink supply hole, sealed by a rubber cap 204*b*, at a bottom and an atmosphere introduction hole sealed by a rubber cap 204*c*. The main tank 204 is an airtight container as a single piece, and ink 259 contains in the main tank 204 without change.

On the other hand, the ink supply unit 205 has an ink supply needle 205*a* for bleeding ink 209 from the main tank 204 and an atmosphere introduction needle 205*b* for introducing atmosphere into the main tank 204. The ink supply needle 205*a* and the atmosphere introduction needle 205*b* are all hollow pins, of which front ends are positioned upward corresponding to positions of the ink supply hole and the atmosphere introduction hole, and the ink supply needle 205*a* and the atmosphere introduction needle 205*b* are respectively inserted into the main tank 204 through each rubber cap 204*b*, 204*c* when the main tank 204 is mounted to the ink supply unit 205.

The ink supply needle 205*a* is connected to the ink supply tube 206 through a passage of a liquid channel 205*c*, a blocking valve 210 and a liquid channel 205*d*. The atmosphere introduction needle 205*b* is communicated with the atmosphere through a liquid channel 205*e*, a buffer chamber 205*f* and an atmosphere communicating hole 205*g*. The liquid channel 205*c*, which is in the lowest position among the ink supply passage from the ink supply needle 205*a* to the ink supply tube 206, and the liquid channel 205*e*, which is the lowest position among the passage from the atmosphere introduction needle 205*b* to the atmosphere communicating hole 205*g*, have the same height together. In this embodiment, the ink supply needle 205*a* and the atmosphere introduction needle 205*b* are thick with an inner circumference of 1.6 mm, and the diameter is 1 to 1.5 mm for the needle hole.

The blocking valve 210 has a diaphragm 210*a* made of rubber, and opens or closes the passage between two liquid channels 205*c*, 205*f* by displacing this diaphragm 210*a*. On an upper surface of the diaphragm 210*a*, a cylindrical spring holder 210*b* is mounted to maintain a push spring 210*c* therein, and the passage between the liquid channels 205*c*, 205*d* are blocked by pushing the diaphragm 210*a* with the push spring 210*c*. The spring holder 210*b* has a flange combined with a lever 210*d* operated by a link 207*e* of the recovery unit 207 described below. The spring holder 210*b* is lifted up against the spring force of the push spring 210*c* by operating the lever 210*d*, so communicating the liquid channels 205*c*, 205*d*. The blocking valve 210 is open when the recording head 201 discharges ink and closed in a standby state or waiting state, so as to be open or closed in good timing with the recovery unit 207 in an ink filling operation described later.

Such an ink supply unit 205 is installed for each main tank 204, that is to say, for each ink color, except the lever 210*d*. The lever 210*d* is common for all colors, and opens and closes the blocking valves 210 for all colors at the same time.

In such a configuration, if the ink in the recording head 201 is consumed, at the instant, the ink is supplied from the main tank 204 to the recording head 201 through the ink supply unit 205 and the ink supply tube 206 owing to the negative pressure. At this time, the air of same amount as the ink supplied from the main tank 204 is introduced from the atmosphere communicating hole 205*g* to the main tank 204 through the buffer chamber 205*f* and the atmosphere introduction needle 205*b*.

The buffer chamber 205*f* is a space purposed for temporarily maintaining the ink discharged from the main tank 204 by the air expansion in the main tank 204, and a lower end of the atmosphere introduction needle 205*b* is positioned to the bottom of the buffer chamber 205*f*. If the air in the main tank is expanded because the circumstance temperature increases or the exterior pressure is decreased during the standby or waiting state of the ink-jet recording device, the ink in the main tank 204 is discharged from the atmosphere introduction needle 205*b* through the liquid channel 205*e* to the buffer chamber 205*f* because the blocking valve 210 is closed. To the contrary, in case that the air in the main tank 204 is deflated owing to decrease of the circumstance temperature, if discharging the ink from the recording head 201 with the ink existing in the buffer chamber 205*f*, the ink in the buffer chamber 205*f* returns to the main tank 204, and after the ink disappears in the buffer chamber 205*f*, the air is introduced into the main tank 204.

A volume Vb of the buffer chamber 205*f* is set to satisfy the environment of using the product. For example, if it is premised that the product should be used in a temperature range of 5° C.(278 K.) to 35° C.(308 K.) and the main tank 204 has a volume of 100 ml, it is set to over $Vb=100\times(308-278)/308=9.7$ ml.

Here, a basic water head of the main tank 204 and behaviors of air and ink in the liquid channel of the ink supply unit 205 when the air is introduced into the main tank 204 are described with use of FIGS. 15A to 15D.

Figure 14:
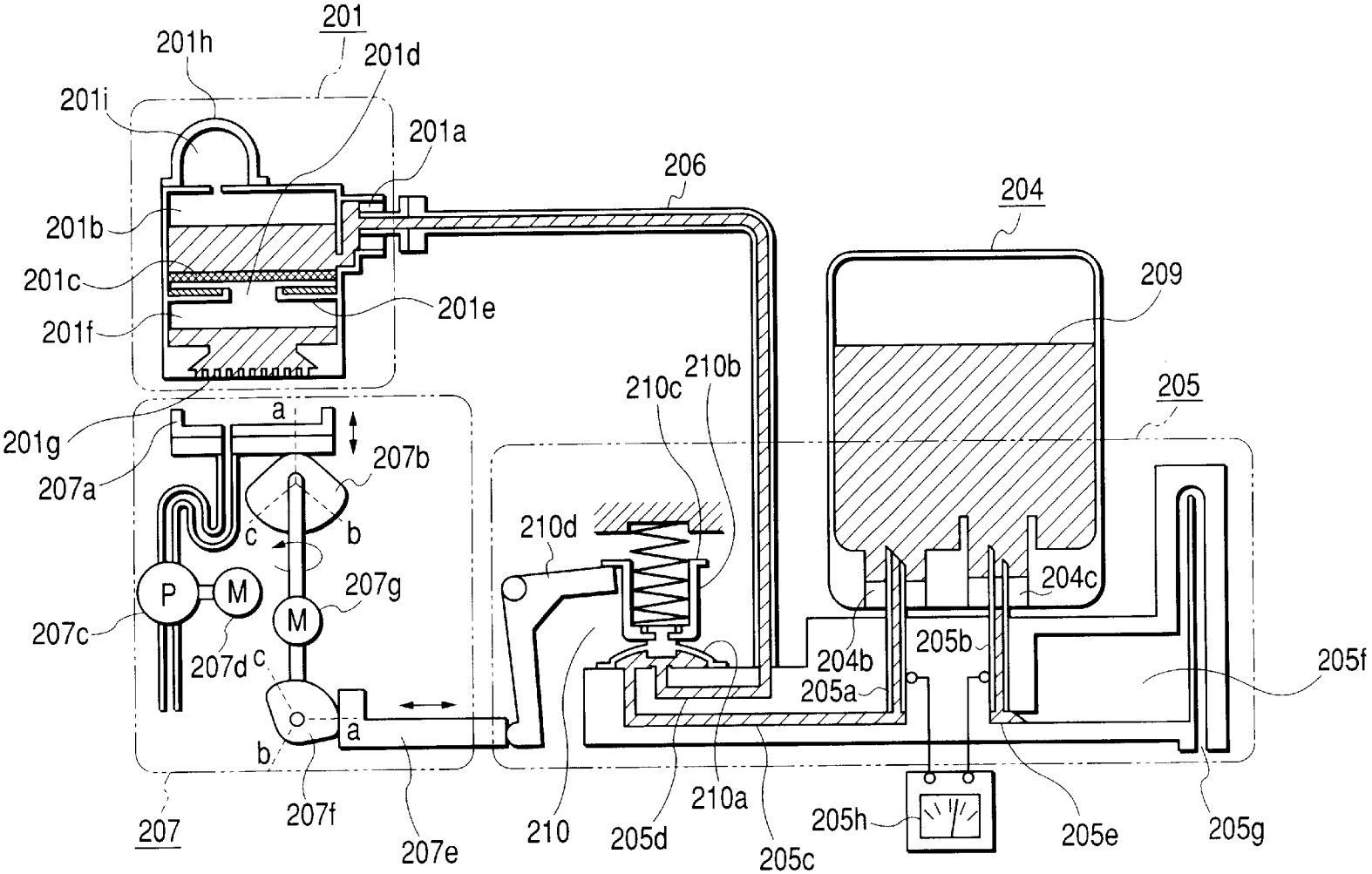
FIG. 14 is a schematic view showing an ink supply unit, a main tank and a recording head of the embodiment of the present invention.
Figure 15A:
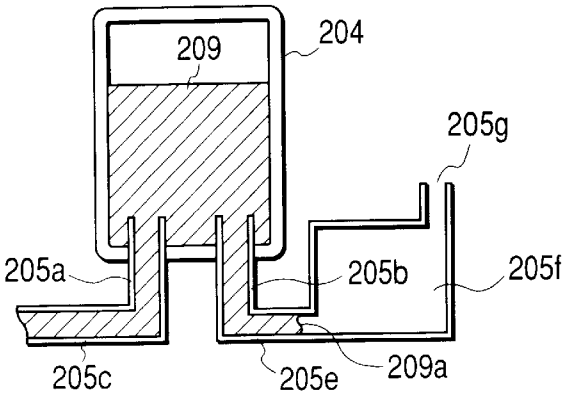
FIGS. 15A, 15B, 15C and 15D are for illustrating a basic water head of the main tank and behavior of air and ink in a flow channel of the ink supply unit when air is introduced into the main tank.

FIG. 15A shows a common state that the ink can be supplied from the main tank 204 to the recording head 201 (see FIG. 14). In this state, because the main tank 204 is sealed except the buffer chamber 205*f*, the main tank 204 maintains a negative pressure and the front end 209*a* of the ink is fixed to a middle of the liquid channel 205*e*. A pressure at the front end 209*a* of the ink is an atmosphere pressure (=0 mmAq) because of contacting the atmosphere.

Because the liquid channel 205*c* in which the front end 209*a* of the ink is positioned is in a same height as the channel 205*e* communicated with the ink supply tube 206 (see FIG. 14), the pressure of the liquid channel 205*c* is also an atmosphere pressure. This is determined by the height relation between the front end 209*a* of the ink and the liquid channel 205*c*, so not being affected by the amount of ink 209 in the main tank 204.

Figure 15B:
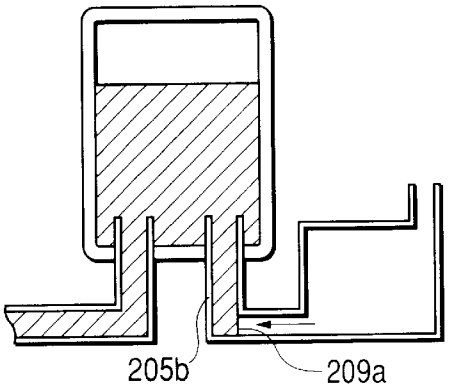
Figure 15C:
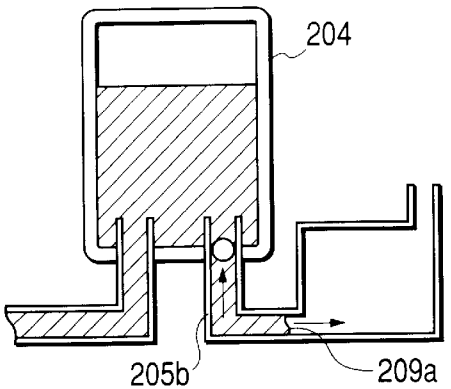

If the ink in the main tank 204 is consumed, as shown in FIG. 15B, the front end 209*a* of the ink slowly moves toward the atmosphere introduction needle 205*b*, and at a point reaching right below the atmosphere introduction needle 205*b*, as shown in FIG. 15C, the front end 209*a* of ink becomes bubbles, so rising into the atmosphere introduction needle 205*b* and being introduced into the main tank 204. The ink in the main tank 204 is penetrated into the atmosphere introduction needle 205*b*, so the front end 209*a* of ink is returned to an original state shown in FIG. 15A.

Figure 15D:
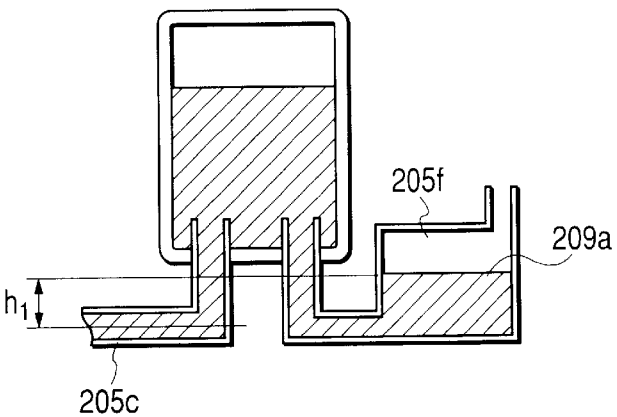

FIG. 15D shows the state that ink stays in the buffer chamber 205*f*. In this case, the front end 209*a* of ink is positioned higher as much as h1 (mm) than the liquid channel 205*c* in a middle height of the buffer chamber 205*f*, and the pressure of the liquid channel 205*c* becomes −h1 (mmAq).

Figure 16:
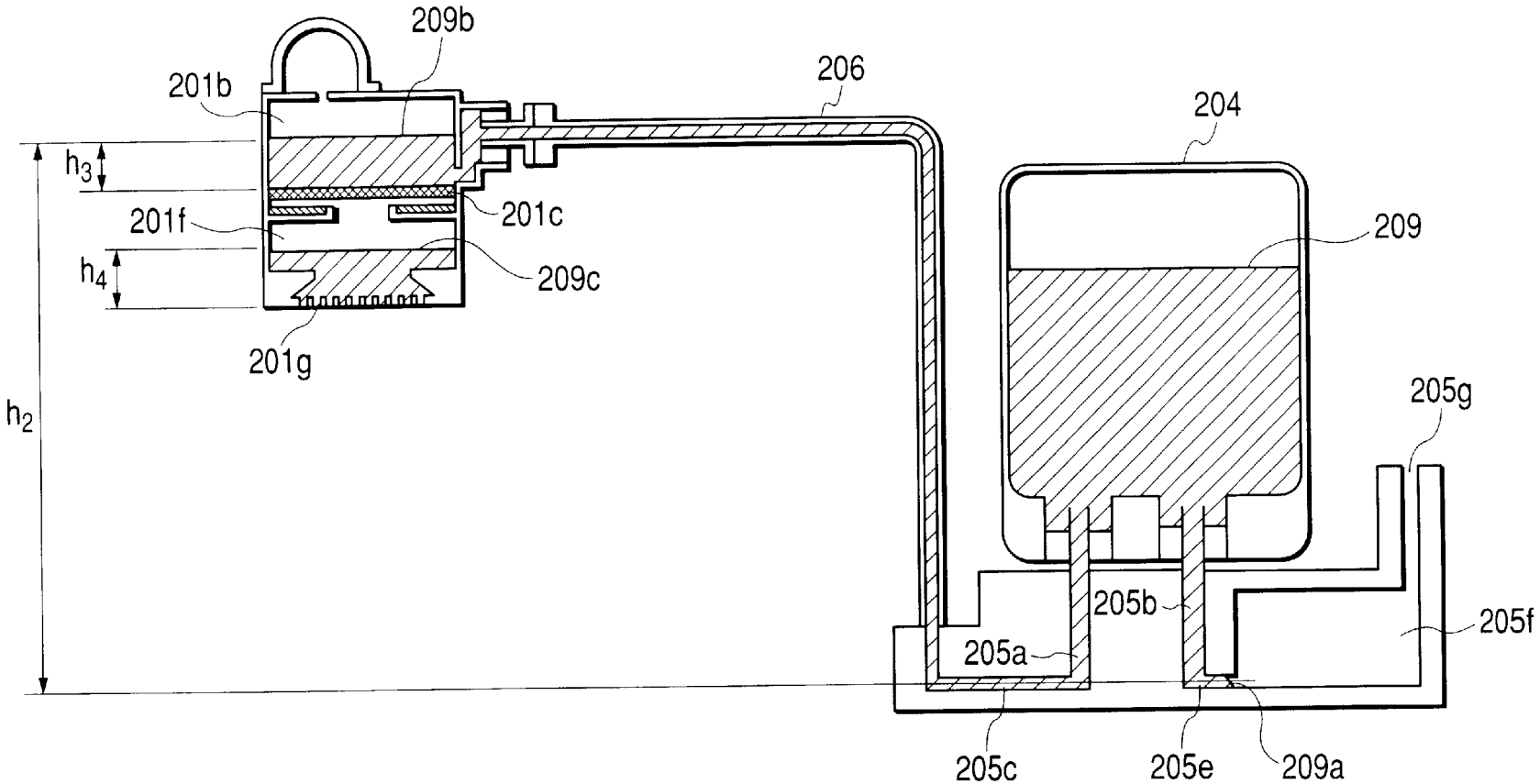
FIG. 16 is for illustrating a basic water head of the main tank and air and ink in the channel of the ink supply unit when the air is introduced in the main tank.

As described above, in this embodiment as shown in FIG. 16, assuming that a height from the channel 205*c* to an ink top 205*b* in the sub tank 201*b* is h2 (mm), a height from the filter 201*c* to the ink top in the sub tank 201*b* is h3 (mm), and a height from a lower end of the nozzle 201*g* to a ink top 209*c* in the liquid chamber 201*f* is h4 (mm), the negative pressure Pn at the lower end of the nozzle 201*g* becomes Pn≃−(h2−h3−h4) mmAq in the common state, and Pn≃−(h2−h1−h3−h4) mmAq in the state that the ink stays in the buffer chamber 205*f*). The value of Pn is set to be within the range (−40 mmAq to −200 mmAq) of the above-described negative pressure.

Referring to FIG. 14 again, a circuit 205*h* for measuring electric resistance of the ink is connected to the ink supply needle 205*a* and the atmosphere communicating needle 205*b*, and becomes in the state of possibly detecting existence or nonexistence of ink in the main tank 204. This circuit 205*h*, in the state of the ink contained in main tank 204, detects electrical close when current flows to the circuit 205 through ink in the main tank 204, but detects electric open when the ink does not exist or the main tank 204 is not mounted. Because the current is weak, insulation of the ink supply needle 205*a* and the atmosphere introduction needle 205*b* is very important, and in this embodiment, it is taken care that the electric current is measured only for the ink in the main tank 204 by completely separating the passage from the ink supply needle 205*g* to the recording head 201 from the passage from the atmosphere communicating needle 205*b* to the atmosphere communicating hole 205*g*.

Now, the recovery unit 207 is described.

The recovery unit 207 acts for sucking ink or air from the nozzle 201*g* and opening or closing the blocking valve 210, and includes a suction cap 207*a* for capping the ink discharging side of the recording head 201 (a side where the nozzle 201*g* is open) and a link 207*c* for operating the lever 201*d* of the blocking valve 210.

The suction cap 207*a* is made of elastic member such as rubber, at least for the portion contacted with the ink discharging side, and installed to be movable in a range between a position of sealing the ink discharging side and a position of being retreated from the recording head 201. A tube having a suction pump 207*c* at a middle portion is connected to the suction cap 207*a* by a pump motor 207*d*, and continuous sucking is enabled by driving the suction pump 207*c* with use of the pump motor 207*d*. And, it is also possible to change a sucking amount depending on a rotation amount of the pump motor 207*d*. In this embodiment, the suction pump 207*c* possibly decompressed to 0.4 atm(40.53 kPa) is used.

The cap 207*b* is for operating the suction cap 207*a*, and is rotated synchronized with a cam 207*f*, which operates the link 207*e*. The timing when each of positions a to c of the cap 207*b* contact with the suction cap 207*a* coincides with the timing when each of the positions a to c of the cam 207*f* contact with the link 207*e*. In the a position, the cam 207*b* separates the suction cap 207*a* from the ink discharging side of the recording head 201, and the cam 207*f* pushes up the lever 210*d* by pressing the link 207*e* so as to open the blocking valve 210. In the b position, the cam 207*b* contacts the suction cap 207*a* to the ink discharging side, and the cam 207*f* returns the link 207*e* to close the blocking valve. In the c position, the cam 207*b* contacts the suction cap 207*a* to the ink discharging side, and the cam 207*f* pushes the link 207*e* to open the blocking valve 210.

In a recording operation, the cams 207*b*, 207*f* are in the a position, and it becomes possible to discharge ink from the nozzle 201*g* and supply ink from the main tank 204 to the recording head 201. In a non-operating state including a standby and waiting state, it is prevented to discharge ink from the recording head 201 (particularly, when the device itself moves, the device may be inclined for the ink to be leaked). The c position of the cams 207*b*, 207*f* is used to fill up the ink to the recording head 201, as described above.

Though the ink supply passage from the main tank 204 to the recording head 201 is described above, in view of a long term, air is accumulated in the recording head 201 in such a configuration shown in FIG. 14.

In the sub tank 201*b*, air penetrated through the ink supply tube 206 or the elastic member 201*h* or air resolved in the ink is accumulated.

As for the air passing through the ink supply tube 206 or the elastic member 201*h*, a material with high has barrier property is used, but because of high prices, such a high effective material may not be used in the household appliances for cost reasons. In this embodiment, a polyethylene tube, which is easily treated owing to high flexibility with low cost, is used for the ink supply tube 206, and a butyl rubber is used for the elastic member 201*h*.

On the other hand, the liquid chamber 201*f* is slowly accumulated with air because bubbles generated by film boiling of ink when discharging ink from the nozzle 201*g* is split to return to the liquid chamber 201*f* or fine bubbles dissolved in the ink is gathered by temperature increase of the ink to become a big bubble.

According to experiments conducted by inventors, in the configuration of the present embodiment, the air accumulated amount in the sub tank 201*b* is approximately 1 ml per month and an air accumulated amount in the liquid chamber 201*f* per month is approximately 0.5 ml.

If the air accumulated amounts in the sub tank 201*b* and in the liquid chamber 201*f* are great, the ink amount contained in each of the sub tank 201*b* and the liquid chamber 201*f* is decreased. As for the sub tank 201*b*, if the ink is lack, a filter 201*c* is exposed to air so as to decrease an effective area of the filter 201*c*, as a result, increasing the pressure loss of the filter 201*c*, so that, at the worst case, the ink cannot be supplied to the liquid chamber 201*f*. On the other hand, if an upper end of the nozzle 201*g* is exposed to air in the liquid chamber 201*f*, the ink cannot be supplied to the nozzle 201*g*. Like that, there may be caused a critical problem if over a certain amount of ink is not contained in both of the sub tank 201*b* and the liquid chamber 201*f*.

Therefore, the ink discharging function may be maintained stable for a long time by filling up a suitable amount of ink in each of the sub tank 201*b* and the liquid chamber

201*f* at a predetermined interval, though not using a material with high gas barrier property. For example, in this embodiment, it will be sufficient if charging an amount of ink, which is calculated by adding an amount of air accumulated for one month to a deviation in the filling process, to the sub tank 201*b* and the liquid chamber 201*f* per one month.

The ink is charged in the sub tank 201*b* and the liquid chamber 201*f* by using the suction of the recovery tank 207. That is, the suction pump 207*c* is driven with sealing the ink discharging side of the recording head 201, and the ink in the recording head 201 is sucked from the nozzle 201*g*. But, the ink sucked from the nozzle 201*g* becomes same amount just by sucking the ink from the nozzle 201*g*, and this ink is flowed from the sub tank 201*b* into the liquid chamber 201*f* and at the same time the ink of the same amount as the ink flowed out from the sub tank 201*b* is flowed from the main tank 204 into the sub tank 201*b*, so not being different with before the suction.

Therefore, in the present embodiment, the sub tank 201*b* and the liquid chamber 201*f* are decompressed to a predetermined pressure by using the blocking valve 210 and then the volume of the sub tank 201*b* and the liquid chamber 201*f* is set in order to charge a suitable amount of ink to each of the sub tank 201*b* and the liquid chamber 201*f* divided by the filter 201*c*.

Now, the ink charging operation to the sub tank 201*b* and the liquid chamber 201*f* and the volume setting are described.

In the ink charging operation, at first the recording head 201 moves the carriage 202 (see FIG. 1) to a position facing with the suction cap 207*a* and drives a cam control unit 207*g* of the recovery unit 207 to be rotated to come in contact with the cams 207*b*, 207*e*. As a result, the ink discharging side of the recording head 201 is sealed by the suction cap 207*a*, and the blocking valve closes the ink passage from the main tank 204 to the recording head 201.

The pump motor 207*d* is driven in this state, and the suction cap 207*a* performs suction by the suction pump 207*c*. By using the suction, the ink and air remaining in the recording head is sucked through the nozzle 201*g*, so decompressing the recording head 201. The suction pump 207*c* is stopped at the time that the suction amount by the suction pump 207*c* reaches at a predetermined amount, and the cams 207*b*, 207*f* are respectively rotated by driving the cam control motor 207*g* so that the c position comes in contact with the suction cap 207*a* and the link 207*e*. As a result, the blocking valve 210 is opened while maintaining the sealed state of the ink discharging side by the suction cap 207*a*. The sucked amount by the suction pump 207*c* is an amount to make a predetermined pressure required so that the pressure in the recording head 201 charges a suitable amount of ink into the sub tank 201*b* and the liquid chamber 201*f*, and it can be obtained by calculation or experiments.

If the recording head 201 is decompressed, the ink is flowed in the recording head 201 through the ink supply tube 206 so that the ink is charged in each of the sub tank 201*b* and the liquid chamber 201*f*. The amount of the charged ink is a volume required that the decompressed sub tank 201*b* and liquid chamber 201*f* returns to near atmosphere pressure, and determined by volume and pressure of the sub tank 201*b* and the liquid chamber 201*f*.

The charging of ink to the sub tank 201*b* and the liquid chamber 201*f* is completed approximately one second after the blocking valve 210 is open. If the charging is completed, the cam control motor 207*g* is driven to rotate the cams 207*b*, 207*f* so that each b position comes in contact with each of the suction cap 207*a* and the link 207*e*. As a result, the suction cap 207*a* is separated from the recording head 201, and then the suction pump 207*c* is driven again to suck ink remaining in the suction cap 207*a*. And, because the valve 210 is still open in this state, the ink is discharged from the nozzle 201*g* so as to be a state of possibly forming text or image on the recording sheet S (see FIG. 1). And, in case of the standby or waiting state, the cam control motor 207*g* is driven again so as to rotate the cams 207*b*, 207*f* so that each b position comes in contact with the suction cap 207*a* and the link 207*e*, so sealing the ink discharging side of the recording head 201 by the suction cap 207*a* and closing the blocking valve 210.

If the amount of ink in the sub tank 201*b* and the liquid chamber 201*g* is not insufficient for a long time, there is no need to perform the suction by the recovery unit 207 frequently and the chance of consuming the ink in vain is decreased. In addition, though it is required to charge ink in both of the sub tank 201*b* and the liquid chamber 201*f*, the charging process is finished only one time, so possibly sparing the ink.

Here, it is assumed that the volume of the sub tank 201*b* is V1, the amount of ink to be charged in the sub tank 201*b* is S1, and the pressure in the sub tank 201*b* is P1 (a relative value to the atmosphere pressure). Here, by the "PV=constant" principle, a suitable amount of ink may be charged to the sub tank 201*b* in the charging process by setting their relation to $V1=S1/|P1|$. Similarly, assuming that the volume of the liquid chamber 201*f* is V2, an amount of ink to be charged to the liquid chamber 201*f* is S2 and the pressure in the liquid chamber 201*f* is P2 (a relative value to the atmosphere pressure), a suitable amount of ink may be charged to the liquid chamber 201*g* in the charging process by setting their relation to $V2=S2/|P2|$.

In addition, the filter 201*c* dividing the sub tank 201*b* and the liquid chamber 201*f* has a fine structure, and has a property that the air flow is difficult when the meniscus is formed as described above. Here, the pressure required to pass the air through the filter 201*c* in which the meniscus is formed is assumed to Pm. In case of suction from the recovery unit 207 to the nozzle 201*g*, the pressure P2 in the liquid chamber 201*f* is lowered as much as the pressure Pm than the pressure P1 in the sub tank 201*b* in order to pas air in the sub tank 201*b* through the filter 201*c*. Therefore, if using this relation to determine the volumes of the sub tank 201*b* and the liquid chamber 201*f*, conditions of the charging operation may be easily determined.

Now, a concrete example for the above-described charging operation and volume setting is described.

The charging of ink is executed once a month, and an amount of air charged in a month is 1 ml in the sub tank 201*b* and 0.5 ml in the liquid chamber 201*f*. And, an amount of ink in the sub tank 201*b* required not exposing the filter 201*c* to air is 0.5 ml, an amount of air in the liquid chamber 201*f* required not discharging the nozzle 201*g* to air is 0.5 ml, a deviation of the charged amount of ink is 0.2 ml for both of the sub tank 201*b* and the liquid chamber 201*f*. These values are obtained through experiments. From them, an amount of ink to be charged once is the sum of them, 1.7 ml for the sub tank 201*b* and 1.2 ml for the liquid chamber 201*f*.

The decompressed pressure in the recording head 201 is set in a range not exceeding the ability of the recovery unit 207. Because an ability limit of the suction pump 207*c* is −0.6 atm(−60.795 kPa) in this embodiment, the suction amount of the suction pump 207*c* is obtained and set with some space so that the pressure in the suction cap 207*a* is to be −0.5 atm(−50.6625 kPa), and controlled by a rotation number of the pump motor 207*d*.

Here, because the pressure required to pass air due to the meniscus of the nozzle 201*g* is experimentally −0.05 atm(−5.06625 kPa), there is generated a resistance difference between the pressure in the suction cap 207*a* and the pressure in the liquid chamber 201*f*, and the pressure in the liquid chamber 201*f* is higher as much as 0.05 atm(5.06625 kPa) than the pressure in the cap 207*a*. Similarly, because the pressure required to pass air due to the meniscus of the filter 201*c* is experimentally −0.1 atm(−10.1325 kPa), there is generated a resistance difference between the pressure in the liquid chamber 201*f* and the pressure in the sub tank 201*b*, so that the pressure in the sub tank 201*b* is higher as much as 0.1 atm(10.1325 kPa) than the pressure in the liquid chamber 201*f*. Therefore, if setting the pressure in the suction cap 207*a* to −0.5 atm(−0.56625 kPa), the pressure in the liquid chamber 201*f* becomes −0.45 atm(−45.5963 kPa), and the pressure in the sub tank 201*b* becomes −0.35 atm(−35.4638 kPa).

In order to charge 1.7 ml of ink to the sub tank 201*b*, the volume V1 of he sub tank 201*b* is set so that the inner pressure of the sub tank 201*b*, of which inner pressure is set to near 1 atm(101.325 kPa), becomes −0.35 atm(−35.4638 kPa) when sucking 1.7 ml of ink. That is, it becomes V1=1.7/0.35=4.85 ml. Likewise, as for the volume V2 of the liquid chamber 201*f*, it is set to V2=1.2/0.45=2.67 ml.

The ink is flowed in the recording head 201 at a negative pressure by opening the blocking value 210 after decompressing the recording head 201 in such conditions. In more detail, first, the ink is flowed in the sub tank 2101*b*, and the air expanded by the decompression to V1 is recovered to near the atmosphere pressure. Assuming that the air volume in the sub tank 201*b* at this point is V1a, it becomes V1a=V1(1−0.35)=3.15 ml, and it is stabilized at the point that the V1−V1a=1.7 ml of ink is charged. Similarly, as for the liquid chamber 201*f*, the ink is flowed in from the sub tank 201*b*, and the air expanded to V2 to the decompression is recovered to near the atmosphere pressure. Assuming that the air volume in the liquid chamber 201*f* is V2a, it becomes V2a=V2×(1−0.45)=1.47 ml, and it is stabilized at the point that V2−V2a=1.2 ml of ink is charged.

As described, a suitable amount of ink may be charged into each of the sub tank 201*b* and the liquid chamber 201*f*, both of which are divided by the filter 201*c*, by setting the volume and decompression of each of the sub tank 201*b* and the liquid chamber 201*f*, and it may be normally operated for a long time without suction even in a state that air is accumulated in the recording head 201.

And, as described above, an air layer is interposed between upper surfaces of ink in the filter 201*c* and the liquid chamber 201*f*, but it is possible to set the amount of the air layer as a suction pressure in the sucking process by the recovery unit 207 as desired. As a result, the air layer is a manageable air layer.

For such a reason, the reliability for the discharging inferiority caused by the bubble generated between the filter and the nozzle may be dramatically improved. That is, as for the conventional problem that an effective area of the filter is changed (decreased) in that bubble not to be managed exists under the filter, in the present invention, the filter 201*c* is in contact with the air layer for the managed portion (the opening 201*d* in FIG. 1) from the first and the effective area of the filter 201*c* does not change, so it is preferable to consider those facts.

And, as for the problem that the bubble covers the flow channel between the filter and the nozzle, because the section of the liquid chamber 201*f* is sufficiently big for the diameter of the bubble, which probably exists in the liquid chamber 201*f*, the bubble in the liquid chamber 201*f* does not disturb the ink flow.

Furthermore, as for the problem that the bubble in the liquid chamber penetrates into the nozzle or clogs the communicating passage between the liquid chamber and the nozzle, because the section of the liquid chamber 201*f* is sufficiently big as described above, the bubble generated in the liquid chamber 201*f* ascends through the ink in the liquid chamber 201*f* by its buoyancy to be mixed with the air layer, so not penetrating the nozzle 201*g*. In addition, though the bubble generated in the liquid chamber 201*f* is mixed with the air layer, because this air layer is a manageable air layer as described, the effective area of the filter 201*c* does not change.

That is, by configuring the sub tank 201*b* and the liquid chamber 201*f* divided by the filter 201*c* as above, the reliability for the discharging inferiority caused by movement of the generated bubble can be dramatically improved.

Figure 17:
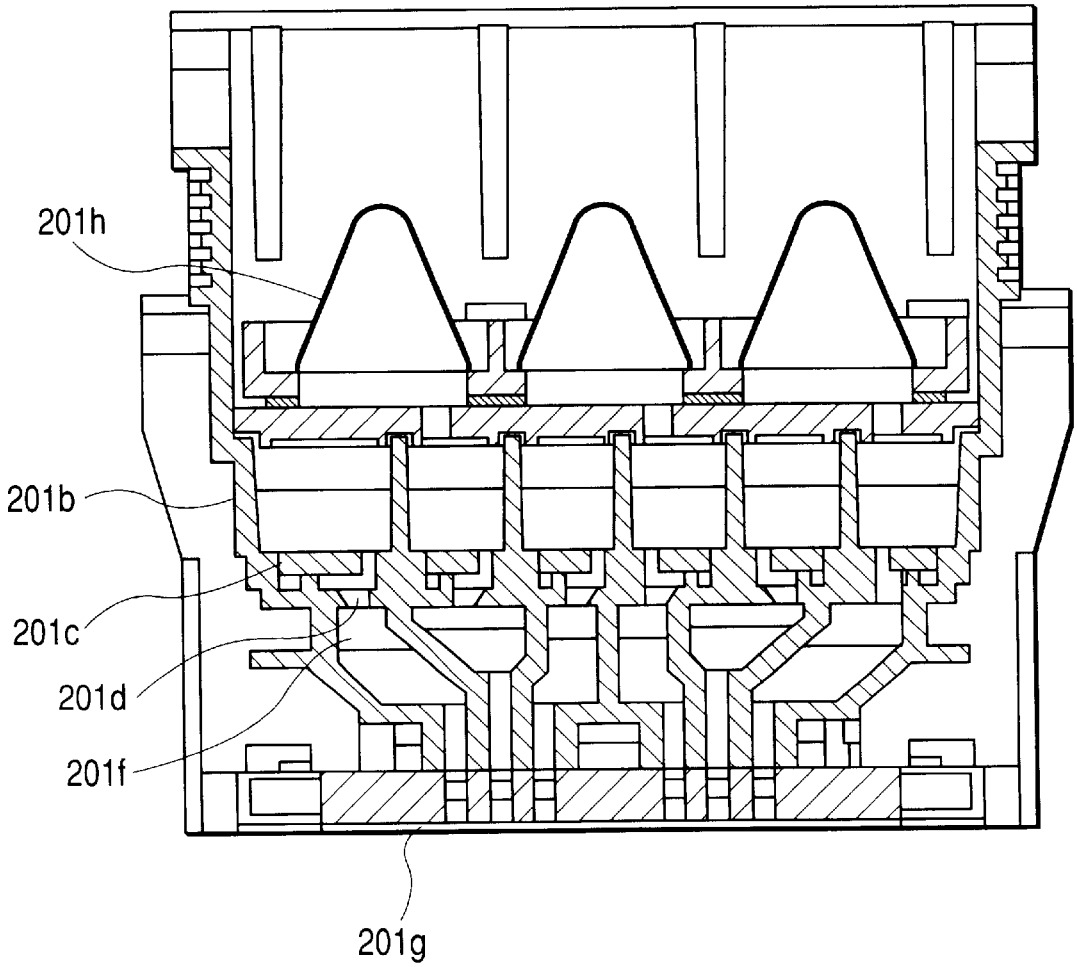
FIG. 17 is a sectional view showing a configuration of the recording head shown in FIG. 14 in detail.

FIG. 17 is a sectional view of the recording head 201 shown in FIG. 14 in detail. The sectional view of FIG. 17 is a figure showing the drawing in FIG. 14 from left to right. The recording head 201 of this embodiment is discharging ink from six nozzles 201*g* respectively, and the ink is independently supplied for each nozzle 201*g* through the main tank 204, the ink supply tube 206, additionally the sub tank 201*b* and the liquid chamber 201*f*.

Figure 18:
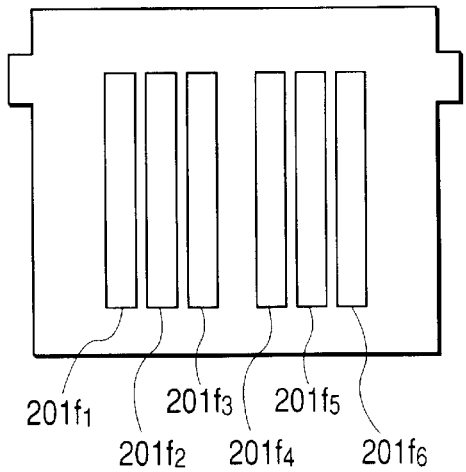
FIG. 18 is a bottom view of the recording head shown from the nozzle.

FIG. 18 is a bottom view showing the recording head 201 from the nozzle 201*g*.

The nozzles 201*g* has a longitudinal direction constituted with a plurality of recording element rows, and 6 nozzles 201*g*1 to 201*g*6 are installed in this embodiment. And, the sub tank 201*b* and the liquid chamber 201*f* also have a shape in a longitudinal direction parallel to the nozzles 201*g*.

In this embodiment, the nozzles 201*g*1 to 201*g*5 are divided into each party 201*g*1 to 201*g*3, 201*g*4 to 201*g*6, and the nozzles are arranged near in each party so that, as a result, the width in the ink discharging side of the recording head is shorter than the width of the sub tank 201*b* group. This is because the sealed space for the ink discharging side by the suction tube 207*a* is decreased.

In case of the ink-jet recording device consuming a large amount of ink like this embodiment, the sub tank 201*b* has a large volume so the sub tank 201*b* group is larger than the conventional one. If the nozzles 201*g*1 to 201*g*6 supplied with the ink from each sub tank 201*b* are arranged below each sub tank 201*b*, the width of the ink discharging side is increased so that the sealed space for the ink discharging side by the suction cap 207*a* is also increased, so enlarging the intake amount. Thus the required suction pump is enlarged, and the enlarged the overall device. In this embodiment, the width of the ink discharging side is shorter than the width for the sub tank 201*b* group as described above, so preventing the device from being oversized.

In this embodiment, because the width of the ink discharging side is shorter than the width for the sub tank 201*b* group, each liquid chamber 201*f* connecting each sub tank 201*b* to each nozzle 201*g* is radially extended from each nozzle 201*g* toward each sub tank 201*b*. Accordingly, the manufacturing cost can be reduced because it may use same suction pump as the prior art and the discharging side made of a plurality of nozzle rows can be used in common with a small ink-jet recording device.

Figure 19:
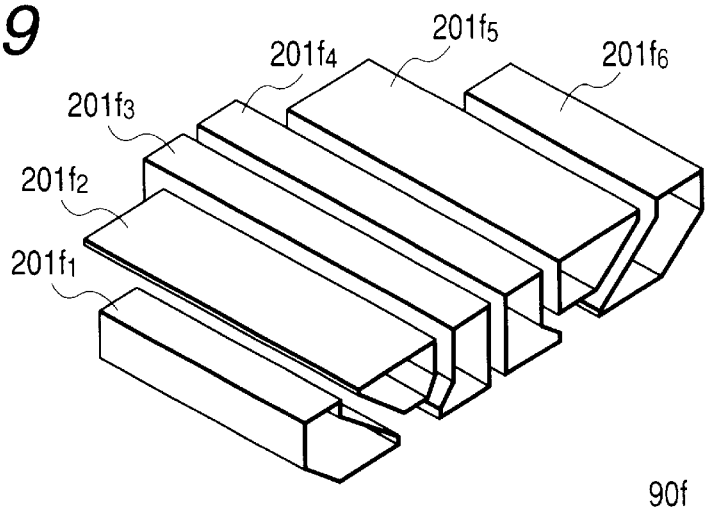
FIG. 19 is a perspective view showing a shape of a liquid chamber used in this embodiment.

FIG. 19 is a perspective view showing a shape of the liquid chamber (ink container) 201*f* used in this embodiment.

The liquid chamber 201*f* of this embodiment is composed of liquid chambers 201*f*1 to 201*f*6 corresponding to each nozzle 201*g*1 to 201*g*6. As described above, each liquid chamber 201*f*1 to 201*f*6 is respectively radially extended from each nozzle 201*g*1 to 201*g*6 toward each sub tank 201*b*, and each liquid chamber 201*f*1 to 201*f*6 has a different shape. Each liquid chamber 201*f*1 to 201*f*6 also has a different length according to its section shape but substantially having same volume. By having same volume as above, it is considered that the volume V2 of each liquid chamber 201*f*1 to 201*f*6, the amount of ink S1 to be charged, and the pressure P2 in the liquid chamber are substantially equal, and with that setting, a suitable amount of ink may be charged to each liquid chamber 201*f*1 to 201*f*6. This is identically applied to the discharging recovery operation.

Figure 20:
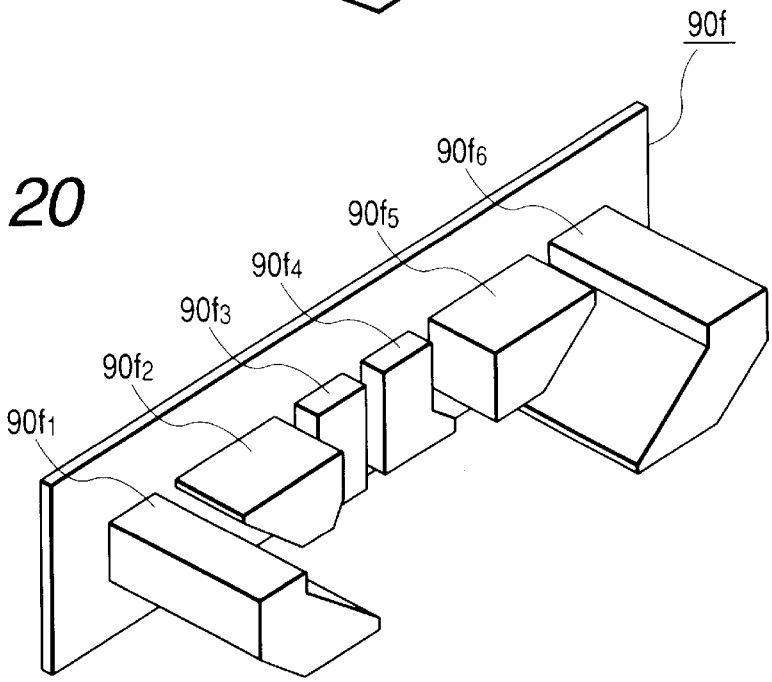
FIG. 20 is for illustrating another embodiment for making volume of each liquid chamber equal.

FIG. 20 is a figure showing essential parts of another embodiment to make the volume of each liquid chamber 201*f*1 to 201*f*6 equal.

Compared with the example shown in FIG. 19 in which each liquid chamber 201*f*1 to 201*f*6 having different length to have same volume are realized with one member, the present embodiment realizes the liquid chamber 201*f*1 to 201*f*6 by composing a first member of same length and a second member corresponding to the first member and having a plurality of protrusions with different length.

A volume adjustment member 901 shown in FIG. 20 has protrusions 9011 to 9016 with different length corresponding to each liquid chamber 201*f*1 to 201*f*6, and makes the volume of each liquid chamber 201*f*1 to 201*f*6 be substantially equal by associating the volume adjustment member 901.

In this embodiment constructed as above, the volume of each liquid chamber 201*f*1 to 201*f*6 is made to be equal by length of each protrusion 9011 to 9016 and adjust the volume itself.

If performing printing by loading the ink-jet recording head using the liquid chamber shown in each embodiment to the ink-jet recording device shown in FIG. 1, it is possible to perform satisfactory printing. And, the ink-jet recording device giving the effects by loading the ink-jet recording head shown in each embodiment is not limited to the serial type as shown in FIG. 1, the line type also gives same effects.

Though the embodiments used in the present invention employs the elastic transformation body of the pressure adjustment chamber used in the ink-jet recording head, it may be applied to other uses and give same effects if coinciding with main points of the present invention.

As described above, the present invention provides the vapor pressure adjustment chamber having at least one elastic transformation body with a changeable volume according to the vapor pressure, in which the elastic transformation body is composed of the approximately circular opening and two approximately flat surfaces at an outer circumference as a shape before transformation, these two surfaces being extended to a front end opposite to the opening through a curved portion, so stabilizing the function of the vapor pressure adjustment chamber and giving effects of enabling the function to be exhibited to the maximum. And, in the recording head having the vapor pressure adjustment chamber employing the elastic transformation body, the arrangement of the elastic transformation body may have enlarged diameter of a bottom of the elastic transformation body for a narrow ink container or an ink container with a limited width when the bottom of the elastic transformation body is shaped circular, so there is provided an effect that the ink unit having a plurality of the ink containers may be received in compact and the ink-jet recording device body itself also may be compact according to the compact recording head. Additionally, because the bottom of the elastic transformation body can be enlarged, it has more possibilities in fact of selecting a shape of the elastic transformation body realizing the function of the vapor pressure adjustment chamber to the maximum.

Because having such a compact recording head, the ink-jet recording device body of the present invention can be compact, which is also preferable to users as a product. The ink-jet recording device also can be low-cost.

What is claimed is:

1. A recording head including:

an ink container having a plurality of ink containing chambers arranged in parallel, each of which independently contains ink, a plurality of ink discharging units for discharging ink supplied from the ink container for recording, each of the ink discharging units corresponding to one of the ink containing chambers, and a pressure adjustment device for adjusting pressure in the ink container, wherein the pressure adjustment device is arranged over upper portions of at least two ink containing chambers, and the pressure adjustment device includes a plurality of elastic transformation bodies arranged in an arrangement direction of the ink containing chambers and in a direction crossing the arrangement direction.

2. The recording head as claimed in claim 1, wherein each elastic transformation body has an approximately circular shape.

3. The recording head as claimed in claim 2, wherein each elastic transformation body includes an approximately circular opening and two surfaces approximately flat before transformation at an outer circumference, and the two surfaces have a shape extended to a curved portion at an end opposite to the opening.

4. The recording head as claimed in claim 1, wherein the pressure adjustment device comprises a plurality of pressure adjustment chambers and the ink container includes openings communicating the pressure adjustment chambers with a plurality of the ink containing chambers.

5. The recording head as claimed in claim 4, wherein each of the openings has a half moon shape.

6. The recording head as claimed in claim 1, wherein the ink containing chambers are arranged approximately parallel to an arrangement direction of the ink discharging units, and each ink containing chamber has a shape radially extended from a communicating portion of the corresponding ink discharging unit toward the pressure adjustment device.

7. The recording head as claimed in claim 6, wherein the volume of each one of a plurality of the ink containing chambers is approximately equal.

8. The recording head as claimed in claim 7, wherein the volume of each one of a plurality of the ink containing chambers is made approximately equal by adjusting a longitudinal length crossing the arrangement direction of the ink containing chambers.

9. The recording head as claimed in claim 1, wherein each ink containing chamber and each ink discharging unit has a longitudinal shape and is arranged so that the longitudinal shapes are approximately parallel to each other.

10. The recording head as claimed in claim 1, wherein each of a plurality of the ink containing chambers independently contains ink of a different color.

11. The recording head as claimed in claim 1, wherein a filter is provided in each ink containing chamber to prevent impurities from being mixed into the ink supplied to the ink discharging units.

12. A recording device comprising the recording head defined in any of claims 1 to 11, a carriage which reciprocates in a straight line and has mounted thereto the recording head, and a carrying means for carrying a recording medium, which receives ink discharged from the ink discharging units of the recording head, in a direction orthogonal to a movement direction of the carriage.

* * * * *

UNITED STATES PATENT AND TRADEMARK OFFICE

CERTIFICATE OF CORRECTION

PATENT NO. : 6,733,117 B2
DATED : May 11, 2004
INVENTOR(S) : Hiroki Tajima et al.

It is certified that error appears in the above-identified patent and that said Letters Patent is hereby corrected as shown below:

Column 3,
Line 56, "305*f*," should read -- 305*f*. --.

Column 4,
Line 42, "an" should read -- a --.

Column 7,
Line 11, "rail," should read -- rails, --.
Line 57, "may" should read -- may be --.

Column 9,
Line 16, "an" should read -- a --.
Lines 27 and 30, "to" should read -- in --.
Line 29, "inflated" should read -- deflated --.
Line 31, "from" should read -- beyond --, "the" should read -- continued --, and "easy" should read -- easy to achieve --.
Line 37, "like" should read -- such as, for example, --.
Line 40, "the" should read -- in the --.
Line 41, "is" should read -- being --, and "lead" should read -- leading --.
Line 56, "it" should read -- it is --.

Column 22,
Line 54, "the enlarged" (first occurrence) should read -- this enlarges --.

Column 24,
Line 54, "half moon" should read -- half-moon --.

Signed and Sealed this

Fifteenth Day of November, 2005

JON W. DUDAS
*Director of the United States Patent and Trademark Office*